US012157603B2

(12) United States Patent
Aliahmad

(10) Patent No.: US 12,157,603 B2
(45) Date of Patent: Dec. 3, 2024

(54) MULTIPLE CONFIGURATION STORAGE BIN AND METHODS OF OPERATION AND MANUFACTURE THEREOF

(71) Applicant: Mirza Aliahmad, South Ozone Park, NY (US)

(72) Inventor: Mirza Aliahmad, South Ozone Park, NY (US)

( * ) Notice: Subject to any disclaimer, the term of this patent is extended or adjusted under 35 U.S.C. 154(b) by 217 days.

(21) Appl. No.: 17/477,369

(22) Filed: Sep. 16, 2021

(65) Prior Publication Data

US 2022/0089317 A1 Mar. 24, 2022

Related U.S. Application Data

(60) Provisional application No. 63/080,256, filed on Sep. 18, 2020.

(51) Int. Cl.

| | |
|---|---|
| ***A47G 29/00*** | (2006.01) |
| ***A47G 29/12*** | (2006.01) |
| ***A47G 29/14*** | (2006.01) |
| ***B65D 6/18*** | (2006.01) |
| *A47G 29/20* | (2006.01) |

(52) U.S. Cl.

CPC ..... *B65D 11/1853* (2013.01); *A47G 29/141* (2013.01); *A47G 29/12* (2013.01); *A47G 29/20* (2013.01); *B65D 7/26* (2013.01)

(58) Field of Classification Search

CPC ..... A47G 29/14; A47G 29/16; A47G 29/22; A47G 29/141; A47G 2029/144; A47G 2029/1257; A47G 2029/148; A47G 2029/142; B65D 11/18; B65D 11/1853; B65D 11/1833; B65D 7/26; B65D 9/14

USPC ..... 220/4.28, 6, 7, 476; 232/17, 2, 19, 41 R, 232/45, 42, 24, 28, 38; 312/248, 258

See application file for complete search history.

(56) References Cited

U.S. PATENT DOCUMENTS

| | | | | | |
|---|---|---|---|---|---|
| 508,870 | A | * | 11/1893 | Colby | A47G 29/12 232/33 |
| 922,181 | A | * | 5/1909 | Ohlson | A47G 29/12095 232/38 |
| 923,903 | A | * | 6/1909 | Silverstein | A47G 29/1201 232/23 |
| 961,647 | A | * | 6/1910 | Ries | A47G 29/20 232/42 |
| 1,005,520 | A | * | 10/1911 | Dodge | B65D 9/14 217/14 |
| 1,014,508 | A | * | 1/1912 | Ohlson | A47G 29/12095 232/17 |

(Continued)

FOREIGN PATENT DOCUMENTS

EP 2982542 A1 2/2019

*Primary Examiner* — Gideon R Weinerth

(57) ABSTRACT

A storage container including one or more of: a first wall configured to be coupled to a support and having bifurcated extensions extending therefrom; a second wall opposed to the first wall and having bifurcated extensions extending therefrom; side walls situated between, and coupled to, the corresponding bifurcated extensions of the first and second walls, the side walls each being configured to fold at a hinge situated between the first and second walls; a bottom wall hingedly coupled to the first wall and configured to prevent the side walls from folding when in a down position; and a cover having proximal and distal ends and a hinge situated therebetween, the cover hingedly coupled to the first wall.

17 Claims, 14 Drawing Sheets

(56) References Cited

U.S. PATENT DOCUMENTS 1,054,408 A * 2/1913 Hammes ..... A47G 29/26 248/312
1,198,524 A * 9/1916 Cunliffe ..... B65D 7/26 220/6
1,241,844 A * 10/1917 Gottschall ..... B65D 11/1833 220/7
1,440,529 A * 1/1923 Carlson ..... A47G 29/12 232/28
1,620,585 A * 3/1927 Walther ..... B65D 7/26 220/6
1,673,769 A 6/1928 Graham
1,744,385 A * 1/1930 Hoffman ..... A47G 29/20 232/41 R
1,791,709 A * 2/1931 Brown ..... A47G 29/14 232/41 R
1,915,980 A * 6/1933 Craft ..... A47G 29/12 232/19
1,972,483 A * 9/1934 Hartson ..... B65D 7/26 220/6
2,022,226 A * 11/1935 Van Buskirk ..... A47G 29/20 232/42
2,023,826 A * 12/1935 Van Buskirk ..... A47G 29/20 232/42
2,071,956 A * 2/1937 Soldt ..... A47G 29/20 232/42
2,229,646 A * 1/1941 Firestone ..... A47G 29/1223 220/6
2,456,479 A * 12/1948 Antil ..... B65D 9/14 312/258
2,669,385 A * 2/1954 Curcio ..... A47G 29/20 232/42
4,714,013 A * 12/1987 Telfer ..... F24B 1/205 99/449
4,944,422 A * 7/1990 Aurness ..... A47G 29/20 220/500
6,540,134 B1 4/2003 Rasche
6,967,575 B1 * 11/2005 Dohrmann ..... G06Q 20/367 340/5.31
10,399,505 B1 9/2019 Brackman
10,537,196 B1 * 1/2020 MacPherson ..... A47G 29/141
10,696,453 B2 * 6/2020 Sena ..... A47G 29/141
10,709,276 B2 7/2020 Guanch
10,743,694 B2 * 8/2020 Raphael ..... A47G 29/141
10,743,695 B1 * 8/2020 Altmaier ..... B60R 9/065
11,172,776 B1 * 11/2021 Logan ..... G08B 13/14
11,197,566 B2 * 12/2021 Aresu ..... A47G 29/124
11,311,132 B2 * 4/2022 Eivaz ..... A47G 29/141
11,492,172 B1 * 11/2022 Izquierdo ..... A47G 29/141
11,617,465 B2 * 4/2023 Zhang ..... A47G 29/141 232/38
11,666,169 B1 * 6/2023 Altmaier ..... A47G 29/20 232/33
11,896,150 B2 * 2/2024 Chiappetta ..... E05G 1/005
12,029,339 B2 * 7/2024 Abderrazak ..... A47G 29/1251
2013/0140255 A1 * 6/2013 Duffy ..... A47G 29/00 211/60.1
2016/0374494 A1 * 12/2016 Geng ..... A47G 29/16 232/17
2017/0188737 A1 * 7/2017 Hippert ..... A47G 29/20
2018/0070753 A1 * 3/2018 Eveloff ..... H04W 4/025
2018/0296016 A1 * 10/2018 Teoh ..... A47G 29/20
2019/0225375 A1 7/2019 Sena
2019/0320836 A1 * 10/2019 Guanch ..... A47G 29/20
2019/0350398 A1 * 11/2019 Raphael ..... A47G 29/141
2020/0352376 A1 * 11/2020 Vernal Silva ..... A47G 29/141
2021/0106160 A1 * 4/2021 Janas ..... A47G 29/30
2021/0127880 A1 * 5/2021 Raphael ..... A47G 29/141
2021/0307550 A1 * 10/2021 Wu ..... A47G 29/22
2021/0355741 A1 * 11/2021 Chiappetta ..... A47G 29/141
2021/0361104 A1 * 11/2021 McLean ..... B65D 15/24
2021/0386196 A1 * 12/2021 Chen ..... A47G 29/141
2022/0008578 A1 * 1/2022 Raphael ..... A47G 29/141
2022/0087416 A1 * 3/2022 Chang Chien ..... A47B 55/02
2022/0117430 A1 * 4/2022 Aresu ..... A47G 29/141
2022/0151421 A1 * 5/2022 Sengstaken, Jr. .. G06K 7/10009
2022/0257041 A1 * 8/2022 Redford ..... B65D 11/186
2022/0267048 A1 * 8/2022 Rogers ..... A47G 29/141
2022/0306337 A1 * 9/2022 Layton ..... B60R 9/065
2022/0346583 A1 * 11/2022 Evangelidis ..... A47G 29/141
2023/0089362 A1 * 3/2023 Bercy ..... A47B 5/02 108/42
2023/0414025 A1 * 12/2023 Meddah ..... A47G 29/20

* cited by examiner

MULTIPLE CONFIGURATION STORAGE BIN AND METHODS OF OPERATION AND MANUFACTURE THEREOF

CROSS REFERENCE TO RELATED APPLICATIONS

This application claims priority to U.S. Provisional Application Ser. No. 63/080,256 filed on Sep. 18, 2020, the entire contents of which is incorporated herein by reference in its entirety.

FIELD OF THE PRESENT SYSTEM

The present system related to a storage bin and, more particularly, relates to a multiple configuration storage bin that is lockable and may be suitable for outdoor use and methods of operation and manufacture thereof.

BACKGROUND OF THE PRESENT SYSTEM

Recently, mail order deliveries have increased consumer convenience as consumers no longer have to go to brick-and-mortar stores to purchase items. To increase delivery speed while reducing delivery costs, many delivered packages, absent instructions indicating otherwise, are simply left outdoors at their designated delivery address. Unfortunately, this may expose the delivered packages to the elements and increase the likelihood of theft and damage. Accordingly, it may be desirable to either leave delivered packages in a protected environment such as in a covered porch or a container that only the intended recipient can open. However, this may not always be possible because of physical and spatial limitations, zoning restrictions, municipal regulations, and homeowner's covenants among other reasons. Accordingly, embodiments of the present system overcome these and other disadvantages of the prior art by providing a foldable delivery container for use in an outdoor environment with enhanced aesthetics.

SUMMARY OF THE PRESENT SYSTEM

The system(s), device(s), method(s), arrangements(s), user interface(s), computer program(s), processes, etc. (hereinafter each of which will be referred to as systems, unless the context indicates otherwise), described herein address problems in prior art systems.

Embodiments of the present system may provide a storage container device that may include one or more of a first wall configured to be coupled to a support and having bifurcated extensions extending therefrom; a second wall opposed to the first wall and having bifurcated extensions extending therefrom; side walls situated between, and coupled to, the corresponding bifurcated extensions of the first and second walls, the side walls each being configured to fold at a hinge situated between the first and second walls; a bottom wall hingedly coupled to the first wall and configured to prevent the side walls from folding when in a down position; and/or a cover having proximal and distal ends and a hinge situated therebetween, the cover hingedly coupled to the first wall.

In accordance with embodiments of the present system, a locking mechanism may be provided and may be configured to selectively secure the cover to the second wall. It is further envisioned that the system may include a controller configured to control the locking mechanism to lock or unlock in accordance with signals received from a wireless transmitter/receiver (Tx/Rx). It is envisioned that the bifurcated extensions of the second wall may form at least a portion of primary and secondary cavities.

It is also envisioned that the secondary cavity may be formed when the storage container is in a closed configuration, and may be defined at least in part by the first and second walls, at least a portion of one of the side walls, and a flange configured to support the bottom wall.

In accordance with embodiments of the present system, the primary cavity may be formed when the storage container is in an open configuration, and may be defined at least in part by the first and second walls, the side walls, and the bottom wall. In accordance with some embodiments, the bottom wall may fold upwards between the bifurcated extensions of the first wall. It is also envisioned that the first wall may include one slotted opening configured to receive a fastener. In accordance with embodiments of the present system the hinge of the cover may be a limiting hinge. It is further envisioned that the second wall may include at least one strike for locking the cover in an unfolded position and at least one strike for locking the cover in a folded position.

Embodiments of the present system may provide an adjustable storage container including: a first wall configured to be coupled to a support and having bifurcated extensions extending therefrom; a second wall opposed to the first wall and having bifurcated extensions extending therefrom; side walls having opposed ends and at least one hinge situated therebetween, the side walls coupled to the corresponding bifurcated extensions of the first and second walls at the opposed ends; a bottom wall hingedly coupled to the first wall and configured to prevent the side walls from folding when in a down position; and/or a cover having proximal and distal ends and a hinge situated therebetween, the cover may be hingedly coupled to the first wall.

Embodiments of the present system may provide an adjustable storage container that may include a first wall configured to be coupled to a support and having bifurcated extensions extending therefrom; a second wall opposed to the first wall and having bifurcated extensions extending therefrom; side walls having opposed ends and at least one rotation limited hinge situated therebetween, the side walls coupled to the corresponding bifurcated extensions of the first and second walls at the opposed ends; a bottom wall hingedly coupled to the first wall and configured to prevent the side walls from folding inward at the rotation limited hinge when in a down position; and a cover having a proximal and distal ends and a rotation limited hinge situated there between, the cover hingedly coupled to the first wall.

BRIEF DESCRIPTION OF THE DRAWINGS

The present invention is explained in further detail in the following exemplary embodiments and with reference to the figures, where identical or similar elements may be partly indicated by the same or similar reference numerals, and the features of various exemplary embodiments being combinable. In the drawings.

It is to be understood that the figures are not drawn to scale. Further, the relation between objects in a figure may not be to scale, and may in fact have a reverse relationship as to size. The figures are intended to bring understanding and clarity to the structure of each object shown, and thus, some features may be exaggerated in order to illustrate a specific feature of a structure.

DETAILED DESCRIPTION OF THE PRESENT SYSTEM

The system(s), device(s), method(s), arrangements(s), user interface(s), computer program(s), processes, etc. (hereinafter each of which will be referred to as system, unless the context indicates otherwise), described herein address problems in prior art systems.

The following are descriptions of illustrative embodiments that when taken in conjunction with the following drawings will demonstrate the above noted features and advantages, as well as further ones. In the following description, for purposes of explanation rather than limitation, illustrative details are set forth such as architecture, interfaces, techniques, element attributes, etc. However, it will be apparent to those of ordinary skill in the art that other embodiments that depart from these details would still be understood to be within the scope of the appended claims. Moreover, for the purpose of clarity, detailed descriptions of well-known devices, circuits, tools, techniques, and methods are omitted so as not to obscure the description of the present system. It should be expressly understood that the drawings are included for illustrative purposes and do not represent the entire scope of the present system. In the accompanying drawings, like reference numbers in different drawings may designate similar elements. The term and/or and formatives thereof should be understood to mean that only one or more of the recited elements may need to be suitably present (e.g., only one recited element is present, two of the recited elements may be present, etc., up to all of the recited elements may be present) in a system in accordance with the claims recitation and in accordance with one or more embodiments of the present system.

Spatially relative terms such as "upwards," "downwards," "under," "below," "lower," "over," "upper," and/or the like, are used for ease of description to explain the positioning of one element relative to a second element. These terms may be intended to encompass different orientations of device of the present system in addition to different orientations than those depicted in the figures. Further, terms such as "first," "second," "one," "the other," and/or the like, may be used to describe various elements, regions, sections, etc. and are also not intended to be limiting. Like terms may refer to like elements throughout the description.

Figure 1:
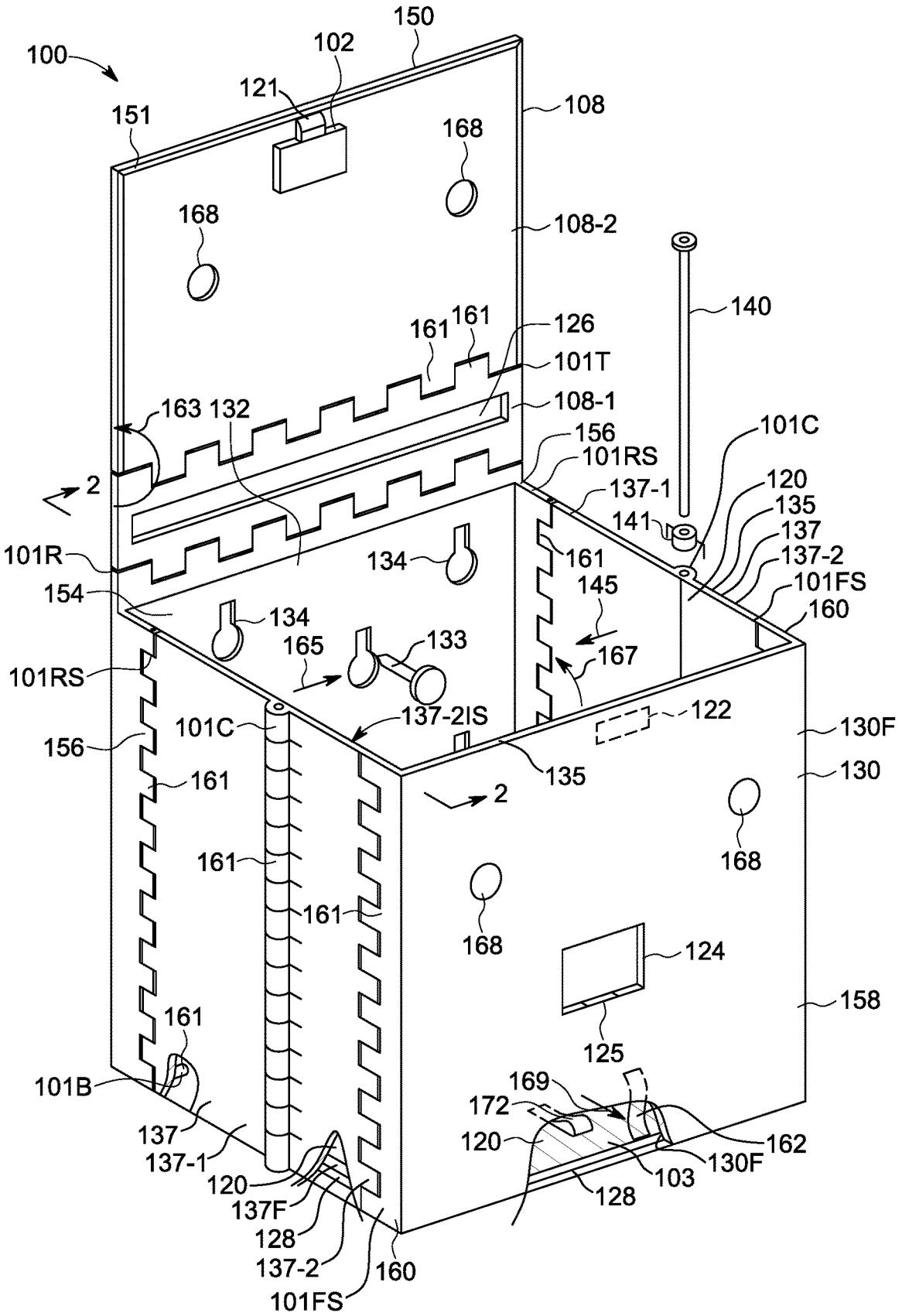
FIG. 1 shows a partially cutaway and exploded front side perspective view of a portion of a collapsible container with a cover and first wall in the open position in accordance with embodiments of the present system.

FIG. 1 shows a partially cutaway and exploded front side perspective view of a portion of a collapsible container 100 (hereinafter system 100) with a cover 108, a first/back walls 132 and second/front wall 130 in the open position in accordance with embodiments of the present system. The first and second walls 132 and 130 are, respectively, coupled to each other by side walls 137 so as to define at least a portion of a cavity 120 having a bottom wall 103 and the cover 108. The cavity 120 may be adjustable to have a variable size.

The first wall 132 may include a center portion 154 situated between bifurcated ends 156 which may extend outward away from the center portion 154 to define a pocket which may be suitable for receiving the bottom wall 103 when it is folded against the first wall 132 such that it does not interfere with the side walls 137 when they are folded.

The second wall 130 may include a center portion 158 situated between bifurcated ends 160 which may extend outward away from the center portion 158 to optionally define at least a portion of a second (e.g., secondary) cavity.

In some embodiments, it is envisioned that the first and second walls 132 and 130, respectively, may oppose each other and be substantially parallel to each other or may be non-parallel with each other. Similarly, the cover 108 and the bottom wall 103 may be opposed to each other and may, at times, be parallel or non-parallel to each other. The opposed side walls 137 may be opposed to each other and may be parallel or non-parallel to each other.

The first wall 132 may be coupled to the respective side walls 137 using any suitable coupler such as hinges 101RS, and may be coupled to the bottom wall 103 using any suitable coupler such as hinge 101B. The first wall 132 may be coupled to the cover 108 using any suitable coupler such as hinge 101R. The cover 108 is shown in the open and unfolded position.

The side walls 137 may have a proximal (back) and distal (front) ends and may include a plurality of side walls, such as side walls 137-1 and 137-2, coupled together at hinge 101C which may be situated substantially at the center of the side wall. Each of the side walls 137 may be coupled at their corresponding proximal end to the first wall 132 by hinges 101RS. Similarly, each of the side walls 137 may be coupled at their corresponding distal end to the second wall 130 by the hinges 101FS.

The cavity 120 may have an opening defined, at least in part, by a top edge 135 of each of the side walls 137 and the second wall 130. Accordingly, an opening of the cavity 120 may be defined by top edges of each of the first and second walls 132 and 130, respectively, and the side walls 137. A seal may be provided to seal the area between one or more of the top cover 108 and the first and second walls 132 and 130, respectively, and the side walls 137. The seal, such as a gasket(s), may be fixedly attached (via adhesive and/or fasteners such as screws, nails, etc.) to the bottom surface and/or a flange 151 of the top cover 108 and/or to the top edges of the side, second and side walls 132, 130, 137.

The cover 108 may include first (or back) and second (or front) portions 108-1 and 108-2, respectively, that may be coupled together using any suitable coupler, such as hinge 101T, and may include the flange 151 situated at or near an outer periphery 150. The flange 151 may be configured to receive at least a portion of the top edge 135 of one or more of the side walls 137 and the first and second walls 132 and 130, respectively. The first wall 132, the second wall 130, the side walls 137, the cover 108, and the bottom wall 103 may generally be referred to as panels 132, 130, 137, 108, and 103, respectively.

A fastening mechanism such as a lock 102 or other suitable locking mechanism may be provided to selectively secure the cover 108 in a closed or locked position in which access to the cavity 120 may be restricted in whole or in part. The fastening mechanism may employ electronic, electromechanical, and/or mechanical fastening and/or control mechanisms. As such, in some embodiments, the fastening mechanism may be activated using a mechanical key or code while in others the fastening mechanism may employ an electronic ID entered via (passively or actively) via a user interface of the system. In some embodiments, the lock 102 may employ one or more latches such as a latch (or bolt) 121 or while in other embodiments the fastening mechanism may employ an electromagnetic fastening mechanism activated by a controller of the system. It is also envisioned that the fastening mechanism may communicate via wired or wireless communication methods. For the sake of clarity, the fastening mechanism employing a single latch 121 is shown in an exposed position. As shown in FIG. 1, the latch 121 is not engaged and the cover 108 is in the open position to receive packages within the cavity 120.

In some embodiments, portions of the fastening mechanism may be concealed if desired. It is also envisioned that the fastening mechanism, or portions thereof, may be coupled to one or more of the panels 132, 130, 137, 108, and 103. For example, the fastening mechanism may include latches that may extend into one or more of the panels 130, 132, and 137. In the present embodiments, it will be assumed that the lock 102 may be of a combination type. However, in yet other embodiments, the lock may be other types of locks such as a pad lock and/or may include a wireless communication system such as a Bluetooth™, a near-field communication (NFC) or other wired or wireless device that may be configured to communicate with an external device and/or user interface to lock or unlock the lock. Authorization methods may be provided to provide access only to authorized devices and/or users. Identification (ID) codes may be determined in advance using any suitable method.

In some embodiments, the fastening mechanism may include one or more actuators (e.g., motors, relays (solenoids, motors, solid state, etc.) configured to activate or deactivate one or more portions of the fastening mechanism. For example, an actuator, such as a solenoid, may provide a motive force to move (or toggle) a mechanical latching mechanism such as a latch to a locked and/or unlocked position as may be desired. While an actuator such as a relay (e.g., solid state or analog) may enable and/or disable an electromagnet to lock or unlock. In some embodiments, the relay may form a portion of the electromagnet.

It is also envisioned that the fastening mechanism may include a wired or wireless communication functionality to facilitate communication with an external device so as to transmit/receive one or more package information (e.g., package ID), status information (e.g., folded, unfolded, locked, open, weights of the empty and/or loaded container and/or packages therein, etc.), and/or operating instructions such as lock, unlock, fold, unfold, etc., and may then be operative accordingly. Ports, such as power and/or communication ports (e.g., ethernet, display, etc.), may be provided for power and/or communication. If desired, the system may include a power source such as a battery pack, capacitor, electro-voltaic (EV) power, wind power, etc., which may provide power to the system. For example, if mounted in rural areas, an EV power source may provide power to the system to enable recharging of one or more batteries of the system under the control of a controller of the system. In some embodiments, one or more panels of the system may include control electronics (e.g., portions of the cover 108) such as a controller. When using wireless communication (e.g., any suitable wireless communication method, protocol, etc. such as Bluetooth™, WiFi, Cellular Networks, etc.), a wireless communication portion (e.g., a wireless transmission portion) such as upconverters, downconverters, and/or antennas may be provided. The controller and associated circuitry and/or power sources may be situated anywhere in the device as may be desired.

In some embodiments, the cover may include an EV cell operative to generate electricity from light (e.g., photons). The controller may control the overall operation of the system and may render information on a display. The display, may for example, be located on the cover 108 and may render information such as a home address, instructions for use, etc. The display may be a touch-screen type display if desired and may be used to provide/output/display and/or input information related to a delivered or to be delivered package(s).

A strike 122 configured to receive the latch (e.g., bolt) 121 of the lock 102 may be formed integrally with, or separately from, one or more of the panels, such as the second/front wall 130, and/or the side walls 137. The positions of the lock 102 and strike 122 may be interchanged such that one or more strikes may be located at the cover 108 and one or more locks may be located at the second/front wall. When employing an electromagnetic fastening mechanism, the strike may include a material which may couple to an electromagnet of the electromagnetic fastening mechanism. The strike 122 may include an opening configured to receive the latch 121 of the lock 102. Locations of the latch 121 and strike 124 may be aligned with each other. More than one lock may be provided by providing latch/strike combination at different locations to lock the cover 108 and or at least one of its portions 108-1, 108-2 to one or more of the panels 130, 137.

One or more of the panels such as cover 108 and/or the second/front panel 130 may include an opening or notch such as a slot 126 for insertion of small or thin packages, such as envelopes and the like, for example. A similar slot for insertion of small or thin packages, may also be provided in the second/front panel 130.

With regard to the hinges, 101B, 101R, 101T, 101RS, 101C, and 101F S (generally hinges 101*x*), these hinges may include any suitable hinge or hinges and may be formed separately from, or integrally with, one or more of their respectively coupled panels (132, 130, 137, 108, 103, etc.). For example, in some embodiments, the hinges 101*x* may include living hinges. In some embodiments, the hinges may include double hinges, etc. For example, the hinges 101C may include double hinges. For the sake of clarity, the hinges may be assumed to be at least partially formed integrally with adjacent portions of the system. For example, each hinge 101*x* may include at least some knuckles (e.g., barrels, etc.) 161 that may be formed integrally with adjacent panels 132, 130, 137, 108, and 103, respectively. In the present embodiments, it will be assumed that the hinges may include hinge knuckles or barrels that may be formed integrally with the panels. In some embodiments, the hinges may include complex hinges. In yet other embodiments, the hinges may be pinless hinges. It is also envisioned that the hinges may include geared type hinges.

In some embodiments, the hinges may be formed separately from, and coupled to, adjacent side panels. One or more of the hinges 101*x* may include a hinge pin (rod, cable, etc.) 140 that may pass through the hinge knuckles 161. However, in yet other embodiments, the hinges may be pin free (e.g., living hinges, etc.). In some embodiments, the hinges may include living hinges that may be molded with one or more adjacent panels or made from the same material as one or more adjacent panels with one or more weakened areas. Such material may be waterproof, such as plastic, rubber, polymers, etc. In some embodiments, a biasing member such as a spring 141 may bias a hinge open or closed. In some embodiments, the biasing member may be formed integrally with or coupled to one or more of the panels.

One or more of the hinges 101*x* may include a travel restrictor which may limit travel of the hinge (e.g., articulation such as rotation about its axis of rotation or total rotation about its axes of rotation if using a complex hinge). For example, the hinge 101T may be configured such that it cannot open substantially past a 180 degree position shown (e.g., see, arrow 163). This may limit the cover from folding back over itself. In some embodiments, a locking mechanism may be provided to lock the cover 108 in a desired position such as in a 180 degree position as shown. In some embodiments, the hinges may be limiting hinges with limited rotation or swing. It is also envisioned that the hinges may include biasing members (e.g., springs, etc.) and/or detents to maintain a position of the corresponding hinge. In some embodiments, an actuator may be provided to cause a hinge to articulate such as rotate under the control of a controller of the system.

Magnetic couplers such as ceramic magnets 168 and/or ferromagnetic pads may be situated in, or otherwise coupled to one or more of the panels 132, 130, 137, 108, and 103 and may be configured to couple to adjacent magnetic couplers in adjacent panels when the system is in desired configuration such as a folded configuration, open configuration, etc. as may be described elsewhere in this application. Accordingly, the magnetic couplers may be aligned such that they may couple when one or more adjacent panels and hold these panels in a desired position such as in a folded position, a closed position, as may be experienced when the system is in the folded configuration or open (e.g., unfolded) configuration.

The first wall 132 may include one or more support areas such as openings 134 suitable for receiving a support fastener such as a screw 133, a nail, a bolt, a rivet, etc., configured to couple the first wall 132 in a desired position and/or orientation relative to a supporting object such as a post, a portion of a house such as a house wall or fascia, a building, a wall, fence, etc. For example, the openings 134 may be slotted such that a fastener may pass therethrough and thereafter coupled firmly to the first wall 132. The slotted openings 134 may include a lower opening portion (nearer to the bottom wall 103) which may be a circular opening having a larger diameter than a width of an upper slotted rectangular portion. However, in yet other embodiments, the support areas may include desired hanging hardware suitable for supporting the system in a desired position and/or orientation.

The second/front wall 130 may include a flange 130F configured to engage and an adjacent notch or a flange 128 of the bottom wall 103. Similarly, the side walls 137 may include a flange 137F configured to engage the flange 128 of the bottom wall 103. The flange 128 of the bottom wall may extend about portions of (or near) an outer periphery of the bottom wall 103. The flanges 130F and 137F are configured to support the bottom wall 103 and may be at different heights such that they will not interfere with each other when the system is folded.

The second/front wall 130 may include a coupler such as a strike 124 including a notch 125 configured to couple to the latch 121 of the locking mechanism 102 when in the folded position so as to hold the cover in a folded position so as to maintain the system in a folded position.

The bottom wall 103 may include ribbing or flanges for reinforcement if desired and may be supported by one or more of the panels 137 and 130 as discussed above. It is also envisioned that the bottom wall 103 and/or the first wall 132 may include a fastener such as a friction fit, a magnet, etc., to hold the bottom wall 103 in position against the first wall 132 when folded against it.

When in the open position, the bottom wall 103 may be fastened in place by a bottom wall latching mechanism such as a latch 162 which may comprise a biasing member (e.g., a sheet of spring steel or plastic) that may extend to lock the bottom wall 103 in location relative to the second wall 130. The latch 162 may be depressed in the direction of arrow 169 (also shown in FIG. 6) by a user and then while still depressing the latch 162, the bottom wall 103 may be pulled upward and articulated such as rotated about an axis of hinge 101B as illustrated by arrow 167 (FIG. 6) to fold adjacent to the first wall 132. A user may grasp the bottom wall 103 from underneath or from within the cavity 120 by pulling on an opening (e.g., extending between major surfaces of the bottom wall 103) or by pulling on a handle such as pull strap 172 suitable for grasping by a user and coupled to the bottom wall 103. In some embodiments, the second wall 130 may include a cutout area to receive at least a portion of the latch 162 when depressed.

In some embodiments, the cover 108 may have a bubble shape to shed elements falling thereon such as rain, sleet, snow, etc. It is also envisioned that portions of the present system may have a shape, feel, texture, and/or color which may match adjacent siding of a house so as to enhance aesthetics.

Figure 2:
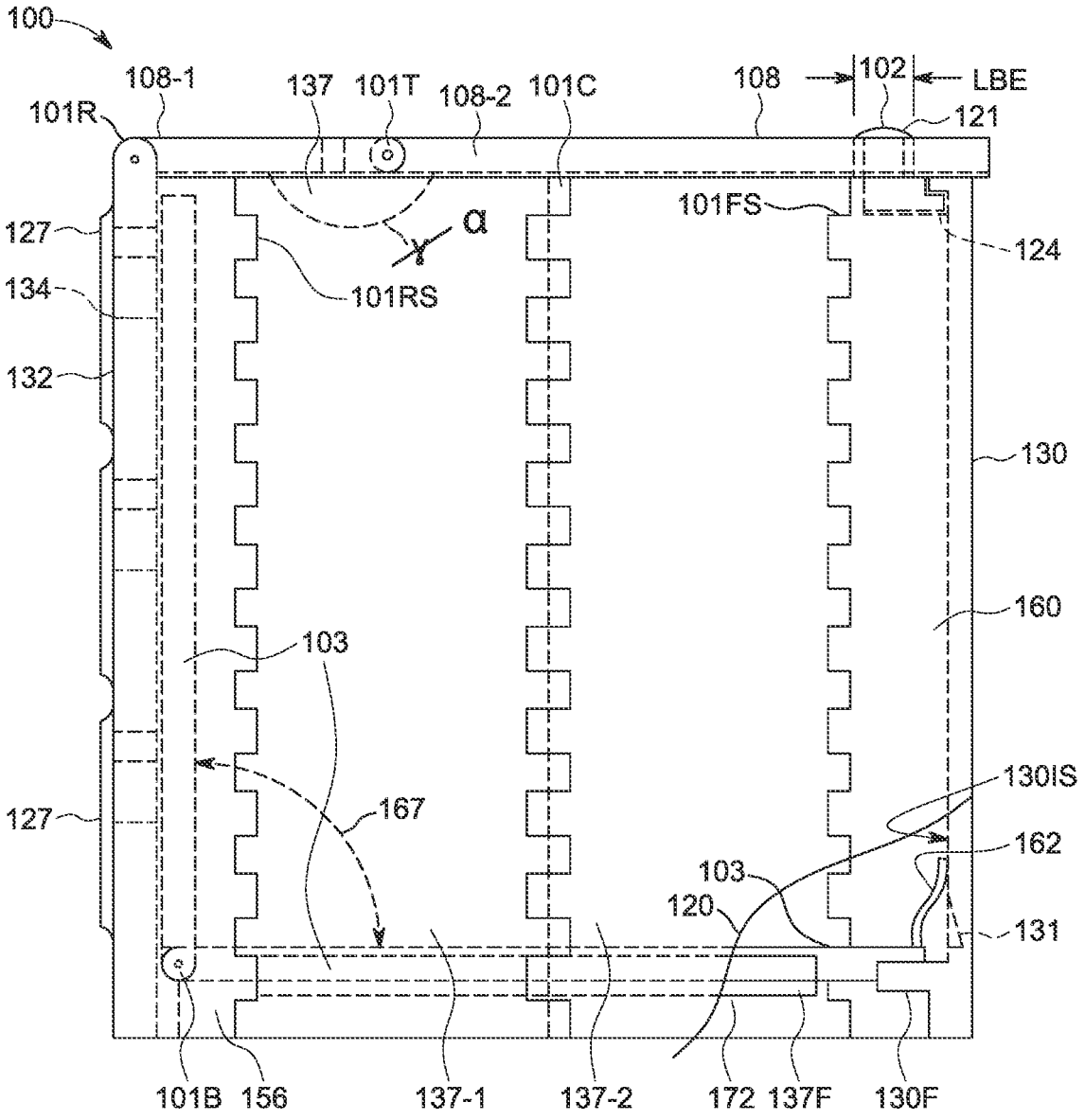
FIG. 2 shows a partially cutaway side view of a portion of the system of FIG. 1 with the cover in a closed position and the second wall in the open position in accordance with embodiments of the present system.

FIG. 2 shows a partially cutaway side view of a portion of the system 100 of FIG. 1, viewed along the direction of line 2-2 of FIG. 1, with the cover 108 in a closed position and the second wall 132 in the open position in accordance with embodiments of the present system. The cover 108 is shown unfolded such that angle alpha α is about 180 degrees. However, when folded, the angle alpha α may be equal to about 90 degrees. Thus, in some embodiments, alpha may have a range of about 90 and 180 degrees (e.g., $90<\alpha<180$). A cutout or notch 131 may be deep enough to receive at least a portion of the latch 162 when depressed so as to provide an optional gap between the latch 162 and bottom wall 103 when the bottom wall 103 is folded and/or unfolded (as shown). The pull strap 172 may be configured to be easily grasped by a user. For example, the openings 134 may be slotted such that a fastener (fastened to a supporting object) may pass through the openings 134 and thereafter be coupled firmly to the first wall 132.

With regard to the cover 108, it may have a length such that it may fully or substantially cover the cavity 120.

Figure 3:
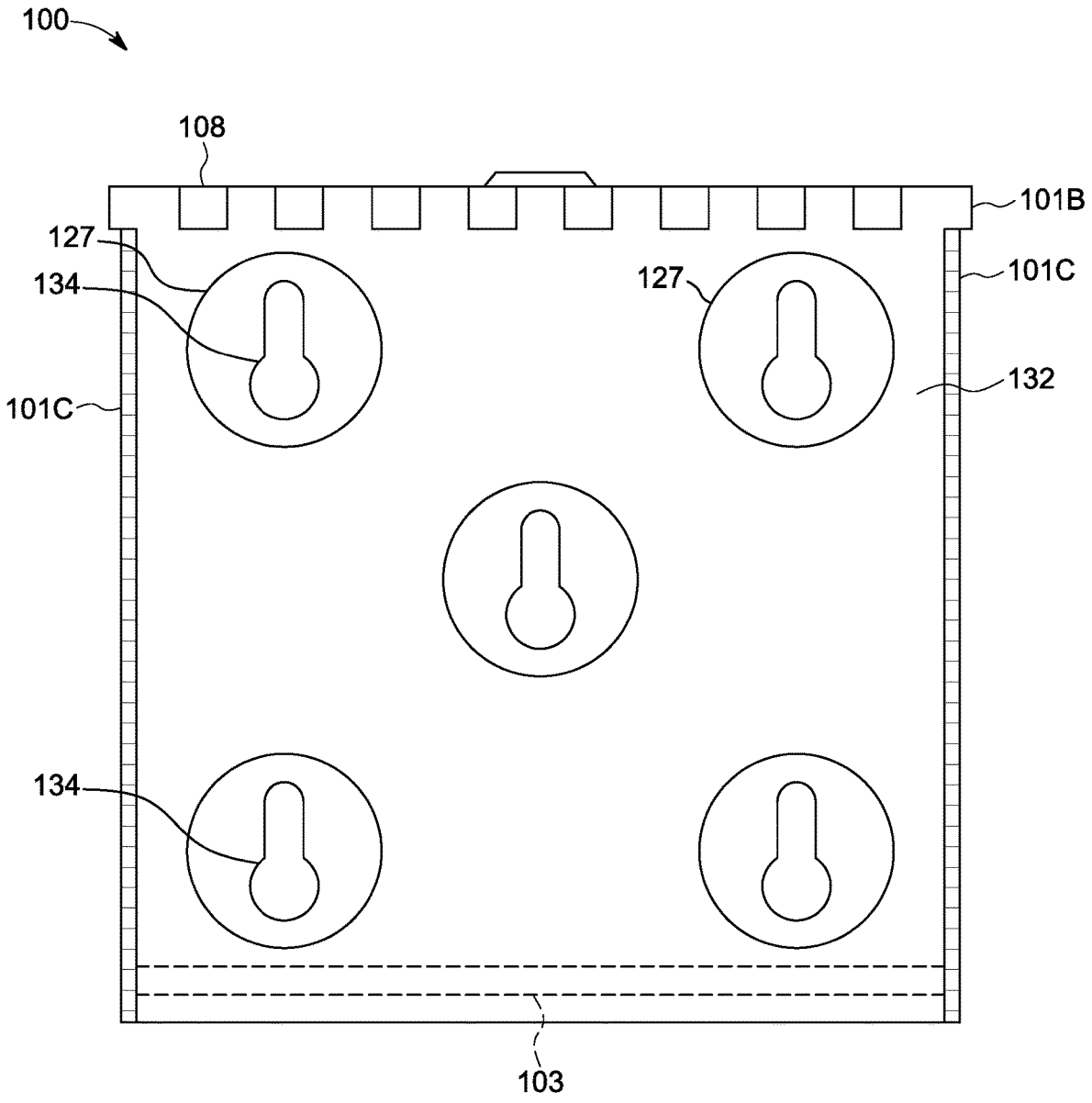
FIG. 3 shows is a rear view of a portion of a collapsible container device system of FIG. 2 in accordance with embodiments of the present system.

The first wall 132 may include a reinforced area to increase rigidity such as a ribbing or pads 127. The pads 127 may have any suitable size and/or shape. For example, the pads 127 may have a circular shape as shown in FIG. 3 which is a rear view of a portion of a collapsible container device system 100 of FIG. 2 in accordance with embodiments of the present system. The pads 127 may further, provide a gap between portions of the first wall 132 and a supporting object such as a wall (e.g., a house wall, a post, etc.) to which it may be attached. This may provide for drainage and/or ventilation as well as stabilize the first wall 132 if the supporting object to which it is attached is not straight.

A length of the bifurcated ends 160 may be referred to as LBE and may be defined as a distance between an interior surface 1301S of the second wall 130 and an axis of rotation of the adjacent hinge 101FS. This length may be set such that when folded, an interior surface 137-21S of the side wall 137-2 may be a distance DC from an interior surface 130IS of the second wall 130 (when folded as will be described elsewhere with reference to FIGS. 4B and 4D).

Figure 4A:
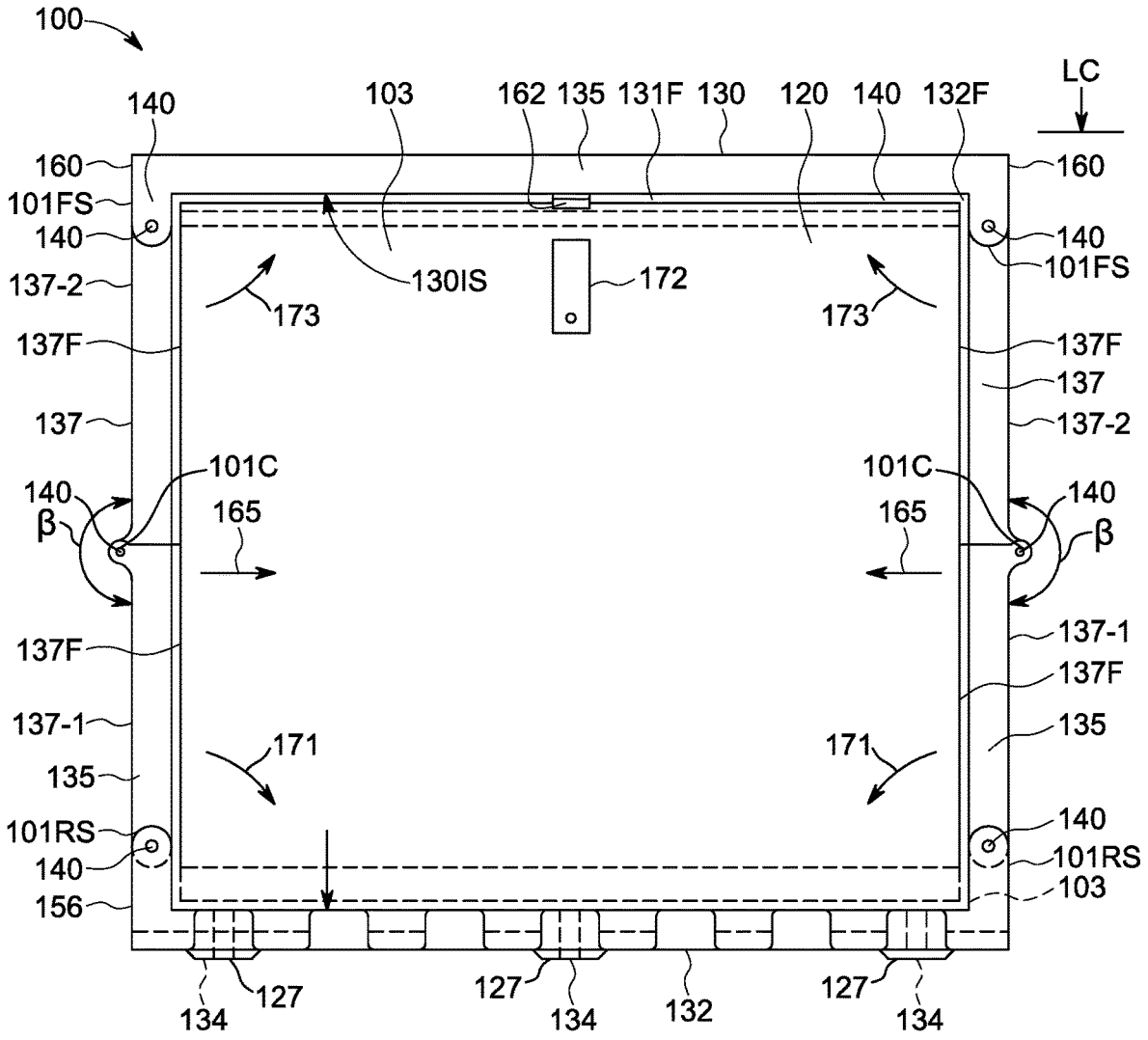
FIG. 4A shows a top view of a portion of the system of FIG. 1 with the cover removed in accordance with embodiments of the present system.
Figure 4B:
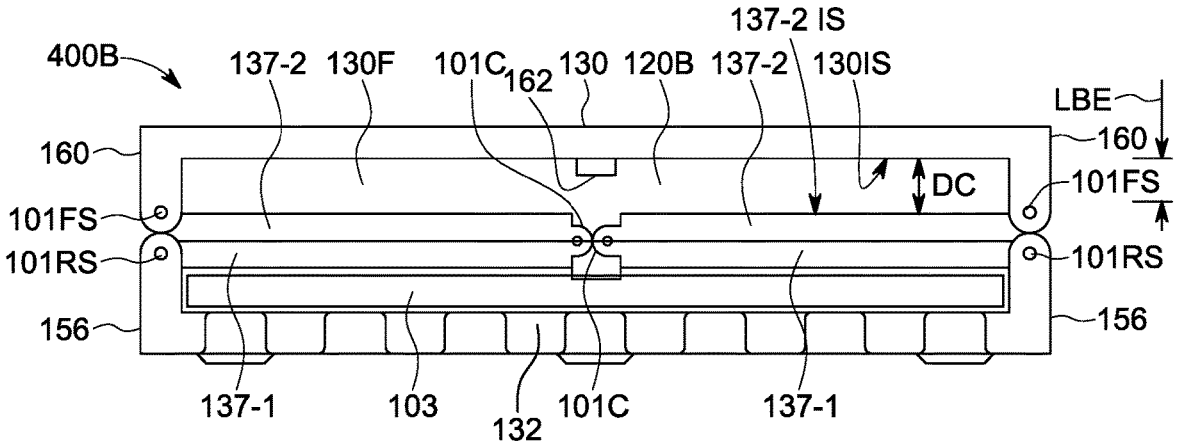
FIG. 4B shows a top view of a portion of the system in a folded configuration with the cover removed in accordance with embodiments of the present system.
Figure 4C:
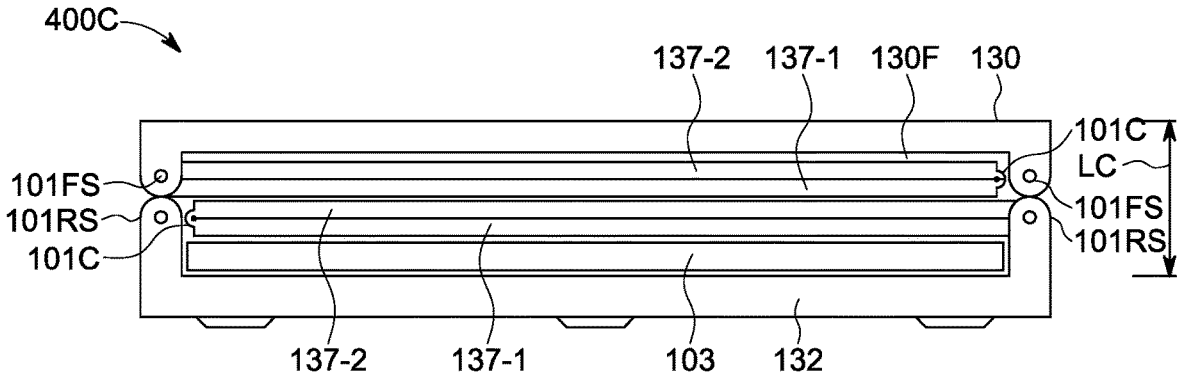
FIG. 4C shows a top view of a portion of a system in a folded configuration with the cover removed in accordance with embodiments of the present system.
Figure 4D:
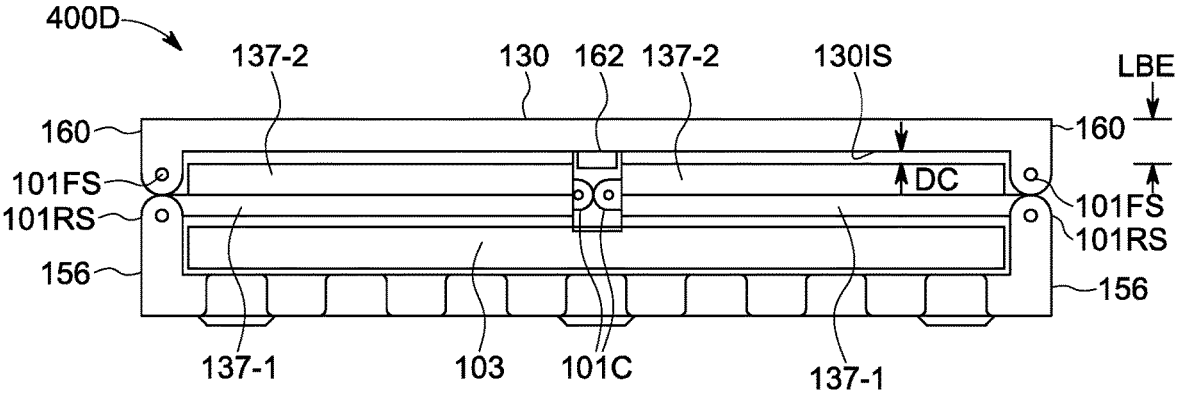
FIG. 4D shows a top view of a portion of a system in a folded configuration with the cover removed in accordance with embodiments of the present system.
Figure 5:
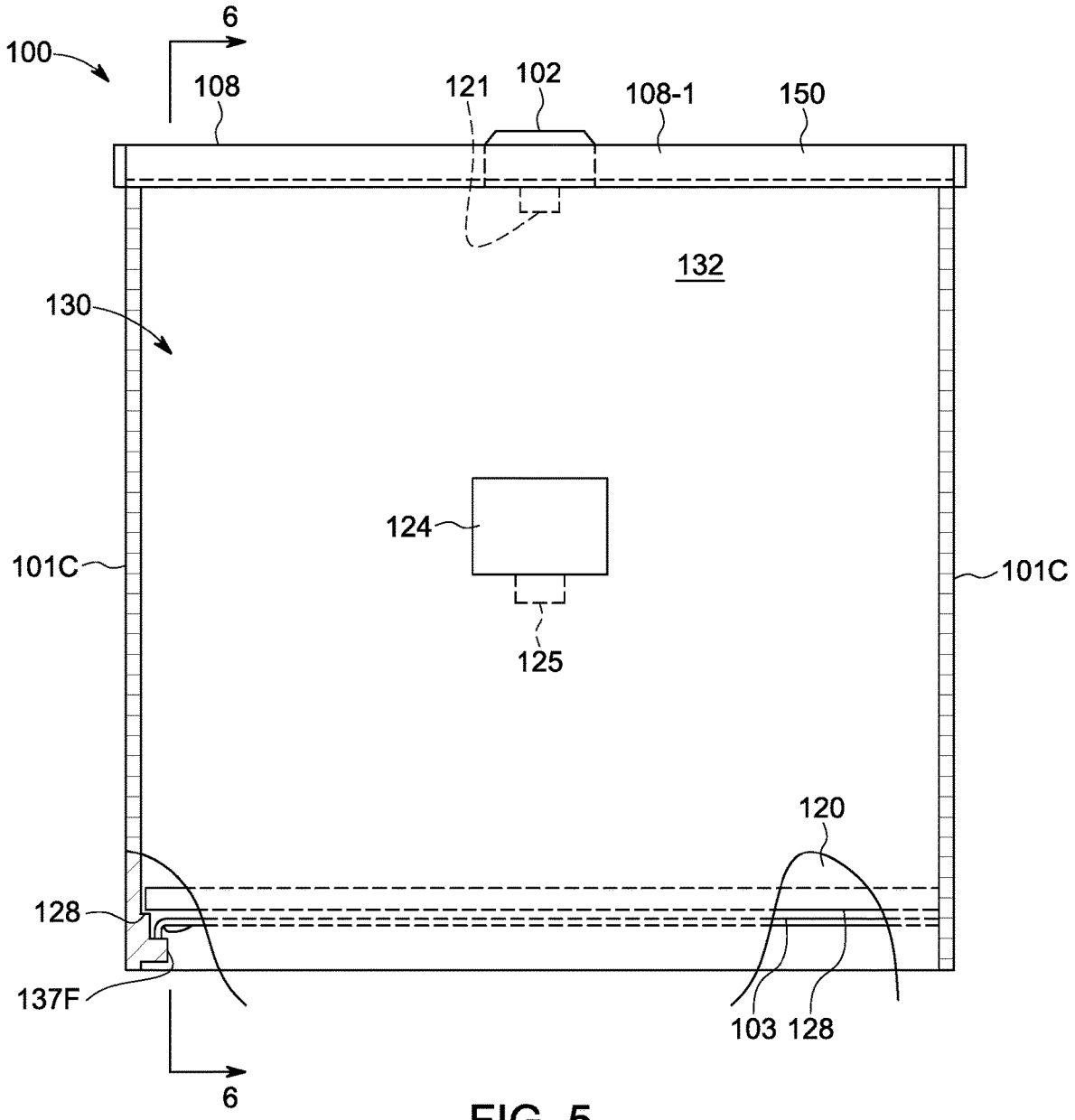
FIG. 5 shows a partially cutaway front view of a portion of the system of FIG. 2 in the open position in accordance with embodiments of the present system.

FIG. 4A shows a top view of a portion of the system 100 of FIG. 1 with the cover 108 removed in accordance with embodiments of the present system; FIG. 4B shows a top view of a portion of a system 400B in a folded configuration with the cover 108 removed in accordance with embodiments of the present system; FIG. 4C shows a top view of a portion of a system 400C with the cover removed in accordance with embodiments of the present system; FIG. 4D shows a top view of a portion of a system 400D with the cover removed in accordance with embodiments of the present system; and FIG. 5 shows a partially cutaway front view of a portion of the system 100 of FIG. 2 in the open position in accordance with embodiments of the present system. The embodiments shown in 400B, 400C, and 400D may be similar to the embodiment 100 with the length of one or more of the bifurcated ends 156 and/or side panels 137 adjusted.

With reference to FIGS. 4A and 5, the bottom wall 103 may be configured to lock the side walls 137 in the open position (e.g., as the system is in the open configuration) and may prevent, or otherwise restrict, the side walls from folding inwards towards each other. Limiters on the hinges 101C may prevent the side walls from bowing outward. The bottom wall 103 may be configured as a cross brace to prevent side-to-side (e.g., transverse) motion of the second wall 130 relative to the first wall 132 when the system is in the open position. The length of the cavity 120 may be referred to as LC and may be defined as a distance between interior surfaces of the first and second walls 132 and 130, respectively. LC may be longer than a second cavity length DC which will now be described with reference to FIGS. 4B and 4D, where DC may be defined as the length of a second cavity 120B. In some embodiments when the system is in a folded configuration (as shown in FIGS. 4B, 4C, and 4D), the second cavity length DC may be substantially equal to 0 in which case the interior surface 137-2IS of the corresponding side wall 137-2 may be adjacent to the interior surface 130IS (e.g., see, FIGS. 4C and 4D). In yet other embodiments, such as shown in FIG. 4B, the second cavity length DC may be substantially greater than 0 in which case, the second cavity 120B may have useable volume and may be at least partially defined by one or more of the side walls 137-2, the second wall 130, the bifurcated ends 160, and the flange 130F. The flange 130F may have a length which may substantially correspond with the second cavity length DC. In some embodiments, the second cavity length DC may be adjusted as desired (e.g., 1 inch, etc.) (c.f., FIGS. 4B and 4C as discussed below). In some embodiments, the length of the bifurcated ends 160 and/or 156 may be fixed or adjustable as may be desired. For example, the bifurcated ends 160 may be shortened so that DC is substantially equal to 0 as shown in FIG. 4C. The bifurcated ends 160 of the second wall 130 may define a pocket which may form at least a portion of the first and second cavities which may be referred to as primary (e.g., 120) and secondary cavities (e.g., 120B), respectively. Extending the bifurcated ends 160 may increase the size of the pocket and vice versa.

Similarly, the bifurcated ends 156 of the first wall 130 may define a pocket which may form at least a portion of the first cavity (e.g., the primary cavity) while having no effect on the second cavity (120B). Extending the bifurcated ends 156 may increase the size of this pocket and vice versa.

With reference to FIG. 4A, the hinges 101C may be a limiting hinge which may provide for limited rotation which may be illustrated by angle beta (β) which may have a range from about zero to about 180 degrees. Thus, $0<\beta<180$. However, other ranges are also envisioned. Hinges with limited freedom of rotation about a hinge axis may be referred to as limiting hinges. Limiters may be built integrally with one or more of the hinges.

With reference to FIGS. 4A, 4B, and 4D, the locations of the hinges 101FS and 101RS may generally be symmetric such that the hinges 101C may be configured to be aligned with each other substantially centered, and such that the hinges 101C are adjacent each other in the folded/closed configuration, as shown in FIGS. 4B and 4D. It is also envisioned that the hinges 101FS may be located aligned with each other. However, asymmetrical location of the hinges 101FS and 101RS is also envisioned such that the respective side walls 137 may now be folded one in front of the other as illustrated in FIG. 4C, instead of adjacent of next to each other along the same axis as shown in FIGS. 4B and 4D. Such asymmetrical location of the hinges 101FS, 101RS, shown in FIG. 4C, may be desirable when the length of the side walls 137 is greater than the width between the hinges 101FS and/or 101RS such that the side walls 137 cannot fold side by side (as shown in FIGS. 4B and 4D where the side walls are folded side by side).

With reference to FIG. 5, the strike 124 may include a cavity or recess in the second wall 130 and may include the notch 125 configured to couple to the latch 121 of the locking mechanism 102 when in the folded position such as may occur when the system is in a folded configuration. In other embodiments, the strike 124 may extend through major surfaces of the second wall 130. In yet other embodiments, a magnetic couple may be employed to lock the cover 108 to the second (front) wall 130 (or vice versa) in the folded position so as to hold the cover 108 in a folded position so as to maintain the system in a folded position.

Folding Process

Figure 6:
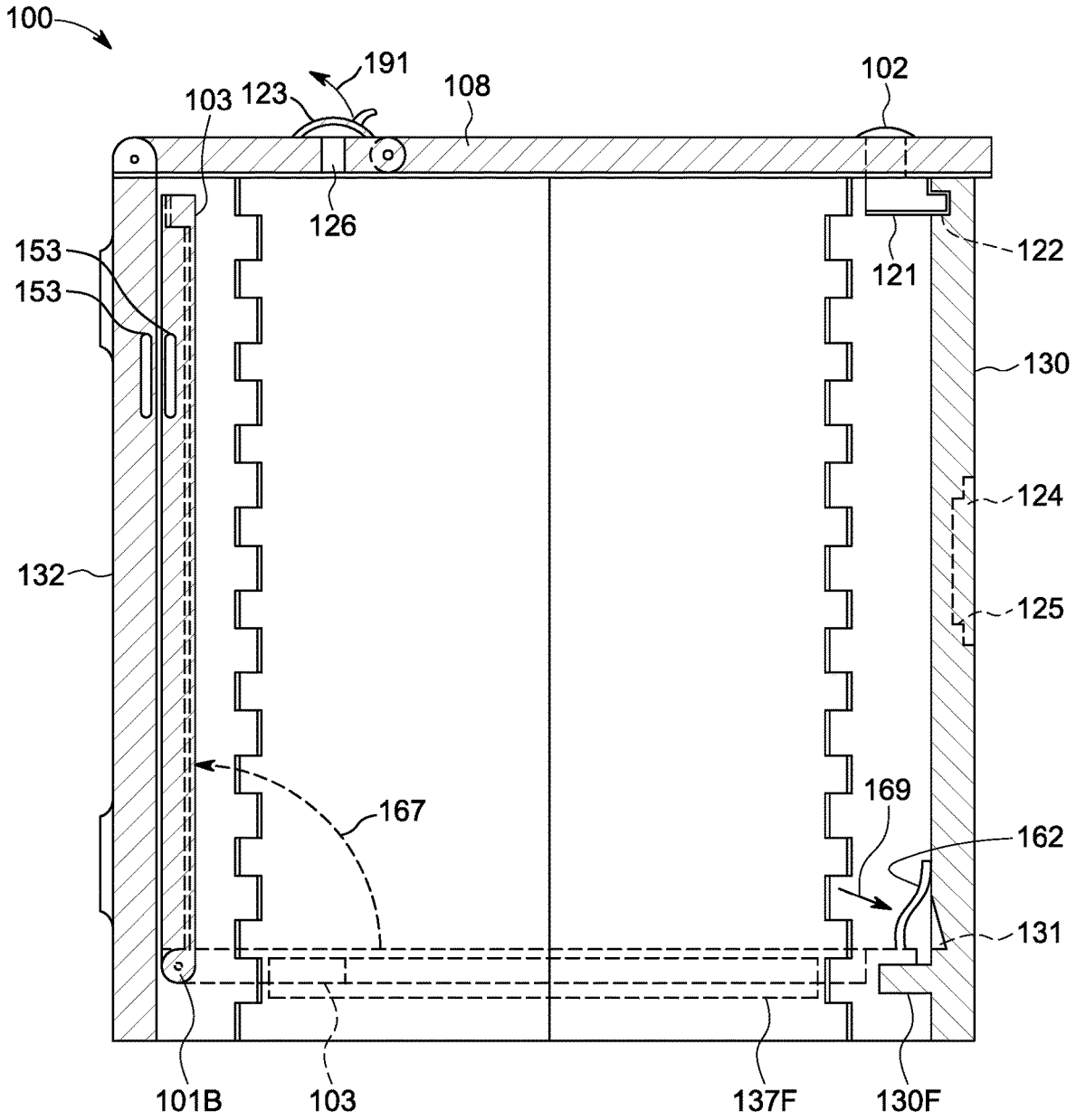
FIG. 6 shows a cross-sectional view of a portion of the system taken along lines of 6-6 of FIG. 5 in accordance with embodiments of the present system.
Figure 7A:
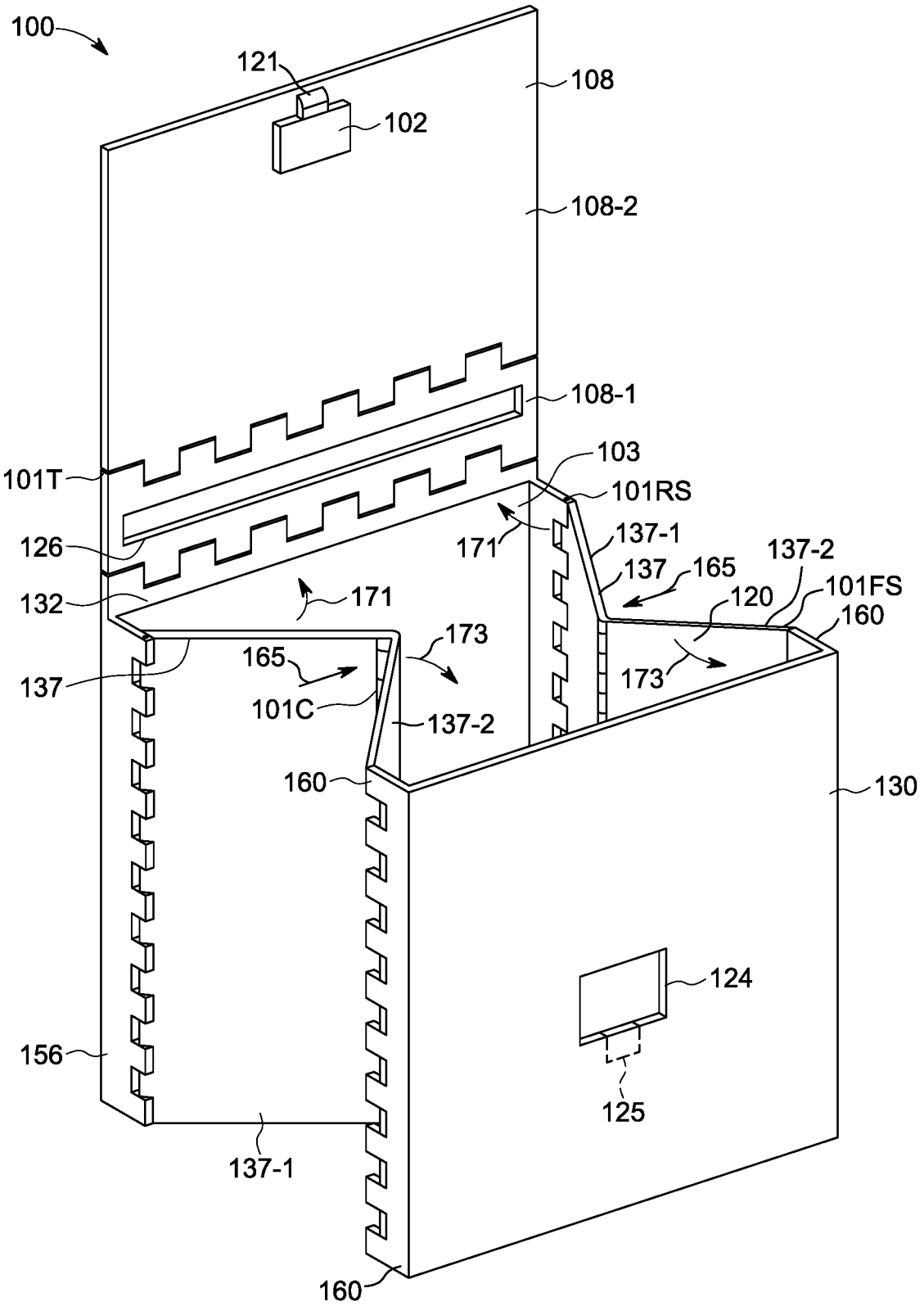
FIG. 7A shows a front side perspective view of a portion of the system in a partially folded configuration in accordance with embodiments of the present system.
Figure 7B:
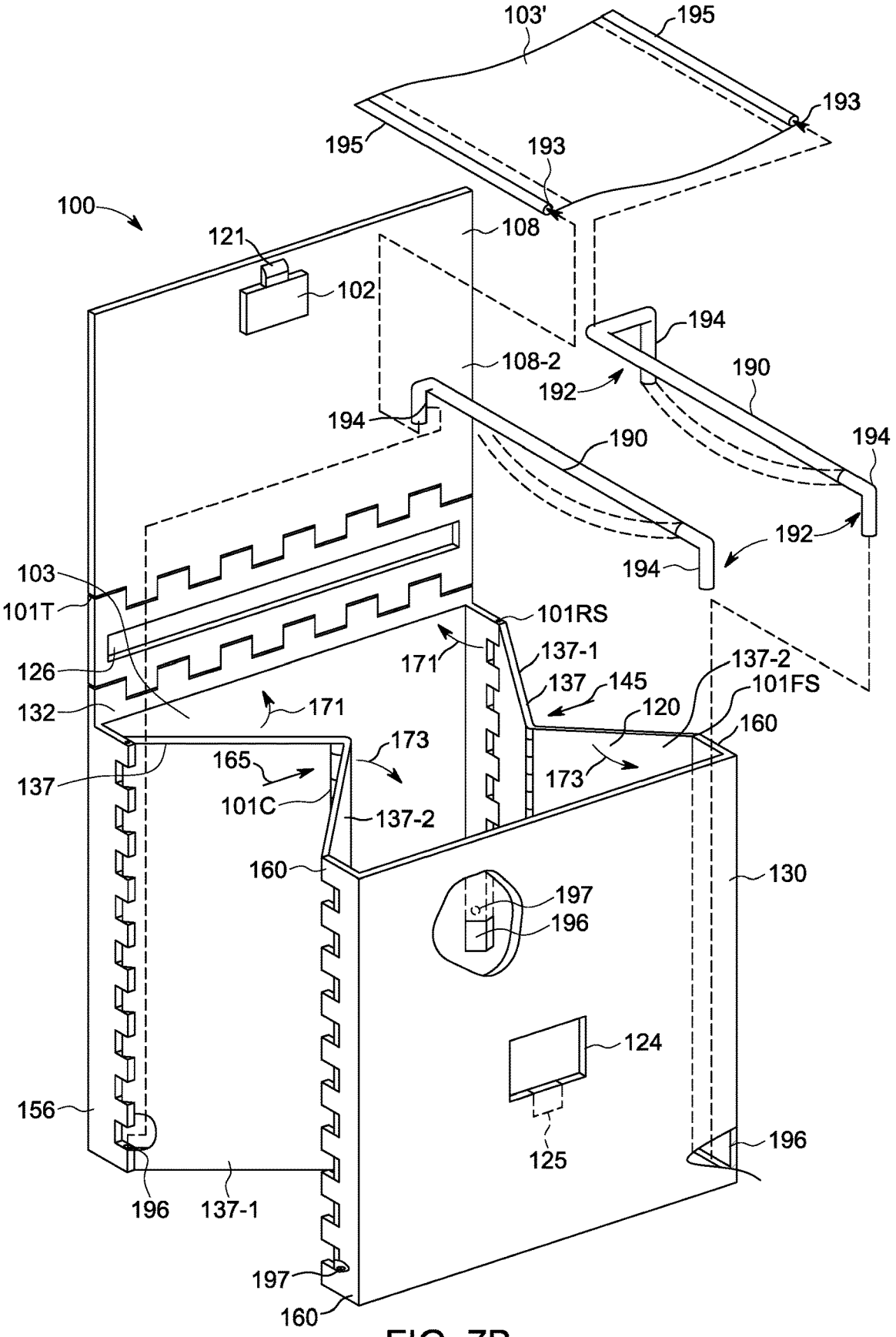
FIG. 7B shows a partially cutaway front side perspective view of a portion of the system in a partially folded configuration in accordance with embodiments of the present system.
Figure 7C:
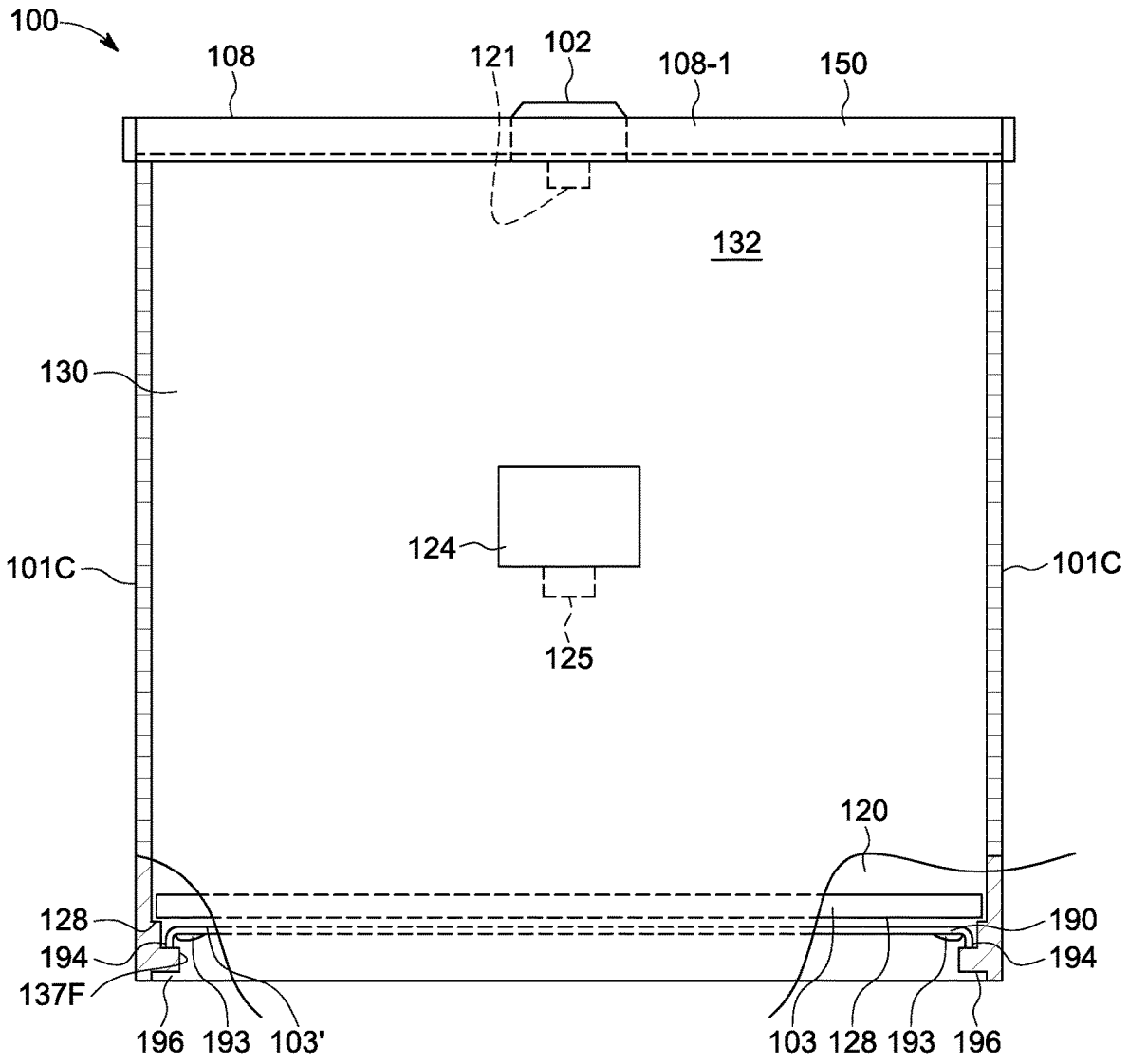
FIG. 7C shows a partially cutaway front view of a portion of the system of FIG. 7B in the open position in accordance with embodiments of the present system.
Figure 8:
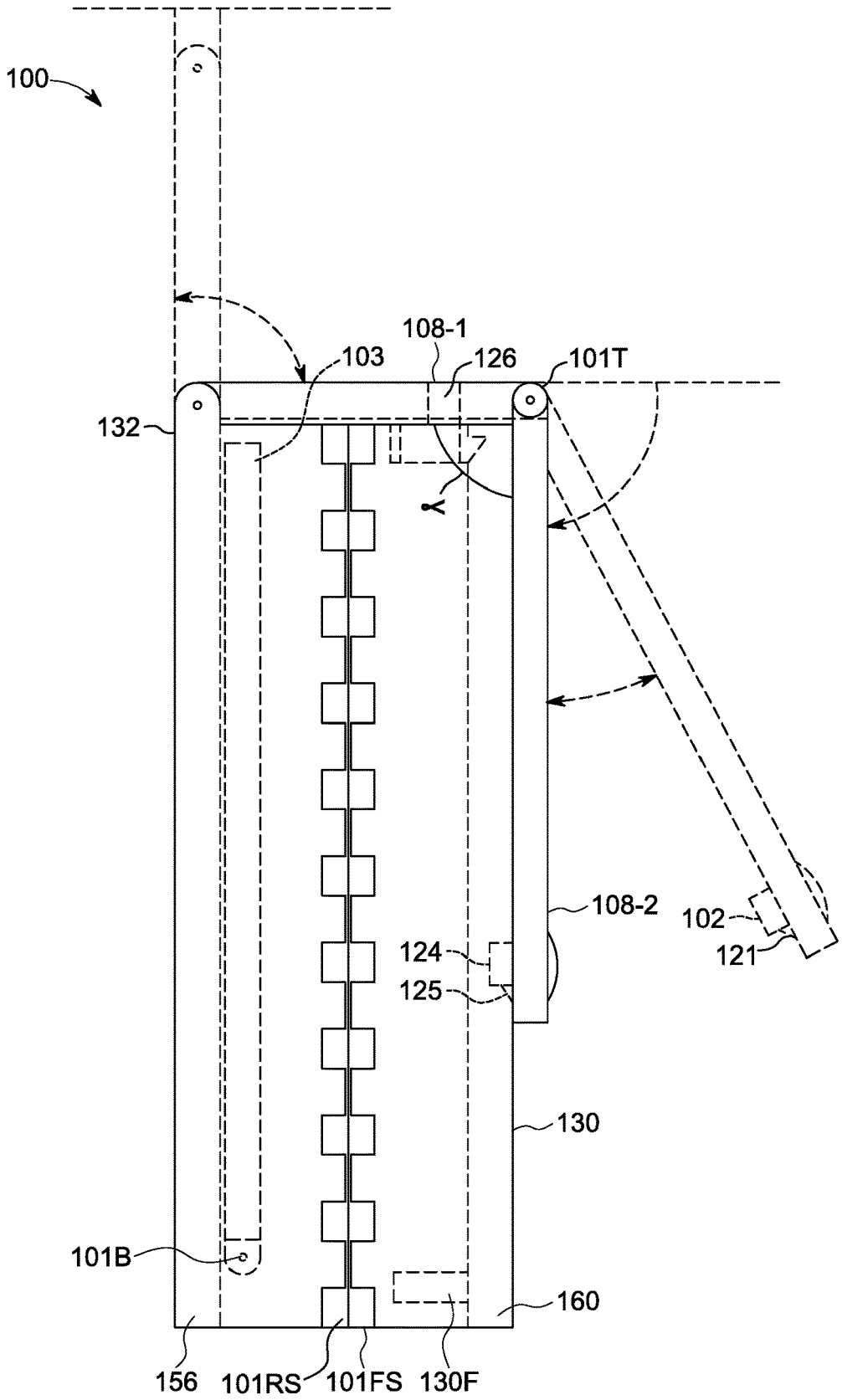
FIG. 8 shows a side view of a portion of the system in a folded configuration in accordance with embodiments of the present system.
Figure 9:
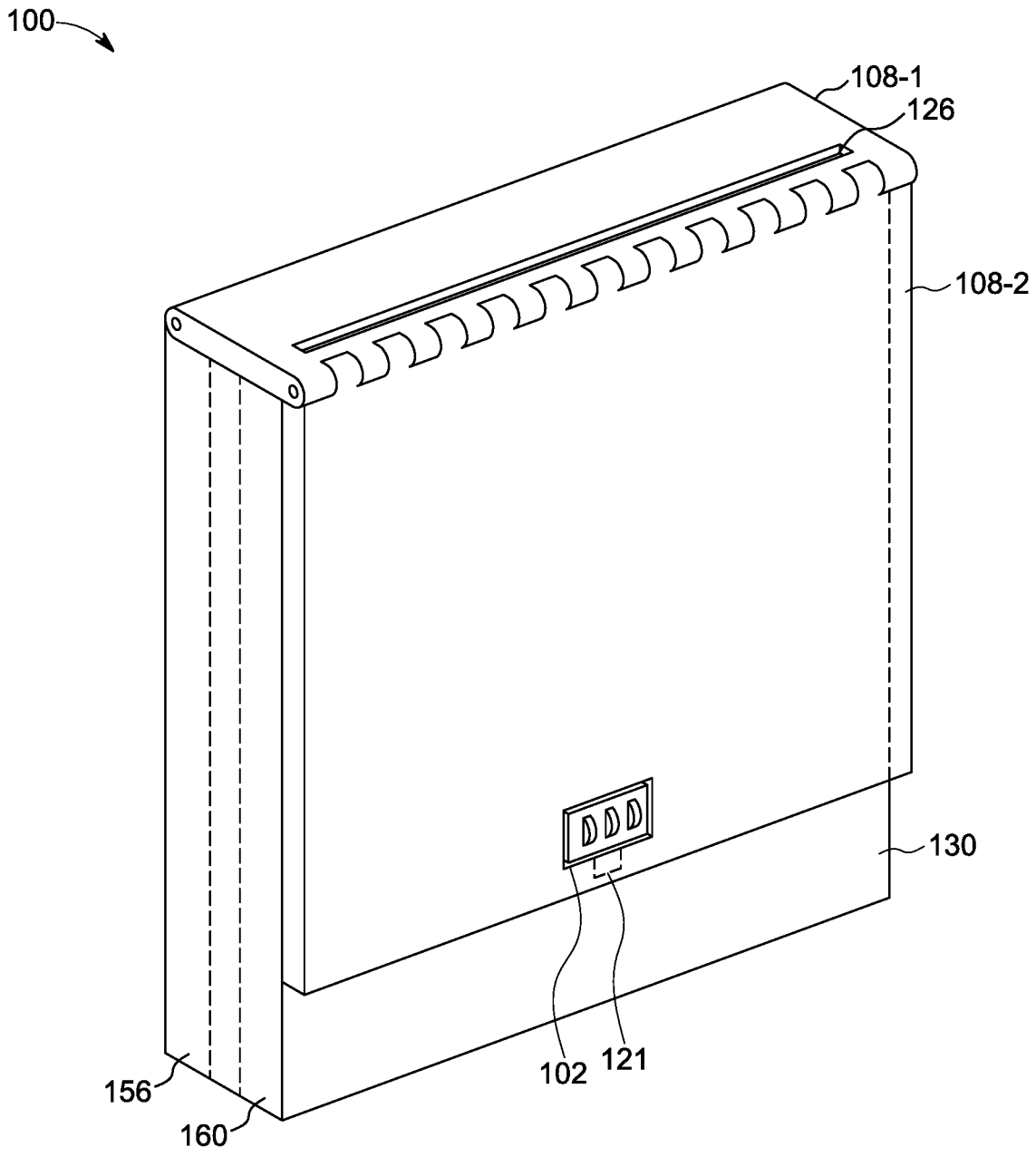
FIG. 9 shows a front perspective view of a portion of the system of FIG. 8 in the folded configuration in accordance with embodiments of the present system.

Methods of folding the system will now be discussed with reference to FIGS. 4A, 4B, 4C and 6 through 9; where FIG. 6 shows a cross-sectional view of a portion of the system 100 taken along lines of 6-6 of FIG. 5 in accordance with embodiments of the present system; FIG. 7A shows a front side perspective view of a portion of the system 100 in a partially folded configuration in accordance with embodiments of the present system; FIG. 8 shows a side view of a portion of the system 100 in a folded configuration in accordance with embodiments of the present system; and FIG. 9 shows a front perspective view of a portion of the system 100 of FIG. 8 in the folded configuration in accordance with embodiments of the present system.

To fold the system 100, it will be assumed that the cover 108 is folded upward into an open position as shown in FIG. 7A. This may provide access to the cavity 120. Then, the latch 162 (FIG. 2) may be released by depressing in the direction of arrow 169 such that it partially enters notch 131 or other space and does not prevent, prohibit, and/or otherwise restrict travel of the bottom wall 103 (e.g., see, FIG. 6). In yet other embodiments, a latch holding the bottom wall 103 may be released.

Once the latch 162 is released or the bottom wall 103 is otherwise free to articulate such as rotate about an axis of the hinge 101B, the bottom wall 103 may then be rotated about an axis (or axes) of the hinge 101B such that portions of the bottom wall 103 may rotate 90 degree upwards toward the first wall 132 as illustrated by arrow 167 such that it is at, near, adjacent to, the first or back wall 132 (e.g., see, FIG. 6). The bottom wall 103 may be held in this folded (up or upward) position by any suitable coupler such as an interference fit, magnets, etc. For example, a magnetic coupler 153 may be employed. As the bottom wall 103 is now folded upward, it will not prevent or otherwise restrict the side walls 137 from folding.

In some embodiments, the cover 108 (namely, the back and/or the front cover portions 108-1, 108-2) may include a slot 126 which may be configured to provide additional access to the cavities 120 and 120B (e.g., see, FIG. 4B) in addition to lifting the cover 108 to access the cavity 120 and/or 120B thereunder. The slot 126 may be configured to receive a desired object such as an envelope, etc. (e.g., in either cavity 120, 120B depending upon configuration of the system 100). While larger packages may be placed in the cavity 120 when the system is open (e.g., in the open configuration rather than closed), smaller packages such as envelopes may be placed in either cavity 120 or 120B depending upon whether the system is open (e.g., cavity 120) or closed (e.g., second cavity 120B). Accordingly, the slot 126 may be aligned with the second cavity 120B. It is also envisioned that the slot 126 may include a covering such as a door 123 (e.g., see, FIG. 6) which may be slidably or hingedly coupled to the cover 108. As shown in FIG. 6, it is envisioned that the covering 123 may be lifted as illustrated by arrow 191 to access the slot 126.

With reference to FIGS. 4A and 7, the respective side walls 137 may now be pushed inwards towards each other (as illustrated by arrows 165) to fold the side walls 137 towards each other at the hinges 101C as illustrated by arrows 165. More particularly, the center portions of the side walls 137 may fold about an axis of their respective hinge 101C such that the center portions of the side walls 137 travel towards each other as illustrated by arrows 165 in FIGS. 4A and 7. During this process, the (back) side walls 137-1 may rotate about the axes of their respective hinges 101RS as illustrated by arrows 173, and the (front) side walls 137-2 may similarly rotate about the axis of their respective hinges 101FS as illustrated by arrows 171 until the (back) side walls 137-1 may fold against, near, or adjacent to, the first (or back) wall 132 and the (front) side walls 137-2 may fold against, near, or adjacent to, the second (or front) wall 130 as illustrated in FIG. 8. In some embodiments, the second/front wall 130 may be pushed towards the first/back wall 132 or vice versa. Then, with reference to FIGS. 8 and 9, the cover 108 may be folded over the first/front wall 132 and/or the second/back wall 130 as shown. In particular, the first/back cover portion 108-1 may be folded over the first/back wall 132 and the second/front cover portion 108-2 may be folded over the second/front 130. The locking mechanism 102 or other coupler may then be secured to the front wall 130 so as to maintain the folded configuration of the system. For example, the latch 121 of the locking mechanism 102 may be coupled to the notch 125 of the strike 124 of the second/front wall 130 so as to hold the cover 108 in the folded position. In some embodiments, the hinges 101*x* may be biased to an open and/or closed position and/or may include detents, such as at least one paired protrusions and notches (configured to receive the protrusions) in two wall portions, to hold a current position. In some embodiments, a gravitational force may be sufficient to hold the cover in place.

To open the system, the locking mechanism 102 (or other coupler) may be released and at least some of the above steps may be performed in reverse. For example, the cover 108 may be unfolded and placed in an upward position as shown in FIG. 7A. Then, the second/front wall 130 may be pulled away from the first/back wall 132 or vice versa so as to at least partially unfold the side walls 137. Then, the bottom wall 103 may be folded downward and locked in place so as to secure the side walls 137 in position relative to each other. The bottom wall 103 may act as a brace to prevent the system from folding.

In some embodiments, the locking mechanism 102 may include a plurality of latches and corresponding strikes configured to receive each other. In some embodiments, the cover 108 may include weather-stripping or the like to at least partially seal the cavities covered thereby to provide at least some protection from the elements.

In some embodiments, a frame may be provided to support the bottom wall. It is also envisioned that a foldable bottom wall may be provided. For example, FIG. 7B shows a partially cutaway front side perspective view of a portion of the system in a partially folded configuration with a further or sub-bottom wall 103' in accordance with embodiments of the present system; and FIG. 7C shows a partially cutaway front view of a portion of the system of FIG. 7B in the open position in accordance with embodiments of the present system. The further or sub-bottom wall 103' may be referred to as a foldable sub-floor and be formed from any suitable rigid or semi-rigid material(s) such as plastic, cloth, etc. and may be incorporated with or without the bottom wall 103 described in connection with the previous Figures, such as FIGS. 1-3 and 5-6.

It is envisioned that the sub-bottom wall 103' may be formed from any suitable material such as film, paper, plastic, cloth, etc., and/or combinations and/or laminations thereof. In some embodiments, the further bottom wall 103' may be folded over and coupled to itself at ends 195 to form pockets 193 suitable to receive corresponding frames 190 such that the sub-bottom wall 103' may be coupled to the corresponding frames 190. In yet other embodiments, any other suitable method to couple the sub-bottom wall 103' to the frames 190 may be employed (e.g., pins, adhesives, bonds, welds, etc.).

Frames 190 may be hingedly coupled to one or more of the second wall 130 and/or the first wall 132 using any suitable methods such as hinges 192 which may include supports 196 having openings 197 (e.g., to form hinge knuckles) configured to receive pins 194 situated at the ends of the frames 190. The frames 190 may be formed from any suitable spring-like material (spring wire, plastic, carbon fiber, fiberglass, etc.) so as to form a live hinge which may provide for the frames 190 to flex and/or otherwise fold about the side walls 137 as the side walls 137 are folded. Conversely, as the side walls 137 are opened, the frames 190 may open. In some embodiments, the frames 190 may include a hinge such as a double hinge configured to provide for the folding of the frames 190 about the corresponding adjacent side wall 137 as the latter is folded.

In some embodiments, the frames 190 may be employed with or without the further or sub-bottom wall 103' and may be configured to support the bottom wall 103 which may rest upon the frames 190.

It is envisioned that the sub-bottom wall 103' and/or a frames 190 may be situated below the bottom wall 103 to support the bottom wall 103. In some embodiments, it is envisioned that the sub-bottom wall 103' may be formed of flexible material such as plastic, rubber, polymers, cloth, etc. and/or combinations thereof, and may be corrugated and/or laminated for added strength, and the frame 190 may be formed of rigid material such as metal, fiberglass, wood, etc.

It is envisioned that the frame 190 may open and close as the side walls 137 are folded and opened, respectively.

In other embodiments, some or all the walls may be insulated to hold foodstuff or other temperature sensitive items. The insulated walls may include one or more of the cover, the side walls, the bottom wall and/or the further bottom wall. The insulation may be attached, such as glued and/or laminated to the walls and may be of flexible material for folding and unfolding along with the wall. The insulation may be plastic, rubber, polymers, cloth, etc. and/or combinations thereof.

Figure 10:
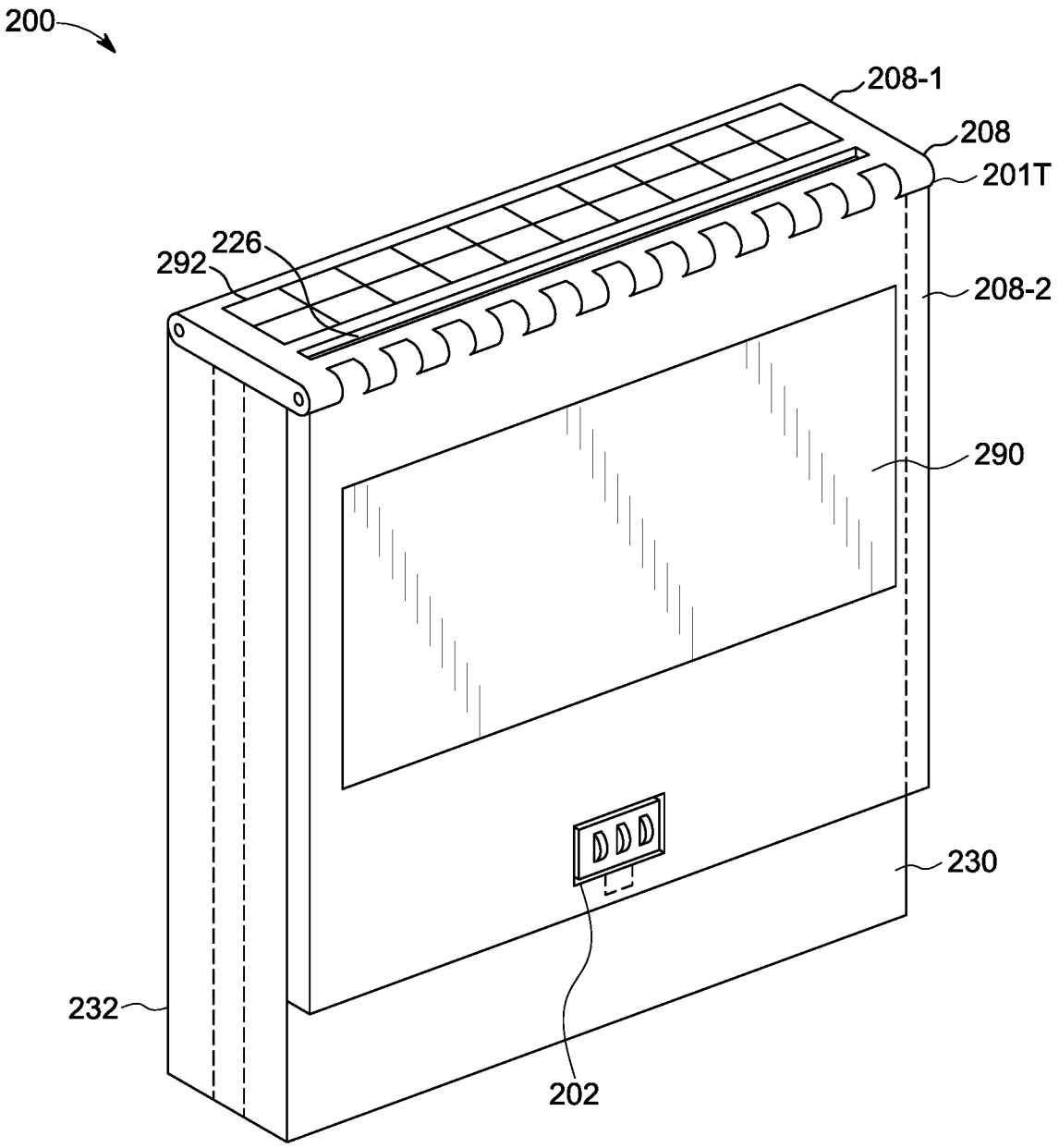
FIG. 10 shows a front perspective view of a portion of the system in the folded configuration in accordance with embodiments of the present system.

FIG. 10 shows a front perspective view of a portion of the system 200 in a folded configuration in accordance with embodiments of the present system. The system 200 may be similar to the system 100 as shown in FIG. 9. However, the system 200 may include a user interface (UI) 290 such as a touch-screen display panel with which a user may interact with the system coupled to a cover 208 and/or the second/front wall 230. The cover 208 may include first/back and second/front portions 208-1 and 208-2 that may be coupled together using any suitable coupler such as hinge 201T (similar to cover portions 108-1, 108-2 that are coupled via hinge 101T of the previous embodiments describing system 100). The first/back cover portion 208-1 and/or the second/front cover portion 208-2 may include a slot 226, similar to the slot 126 of the system 100. The first/back and second/front walls 232 and 230, respectively, and side walls may be similar to the first and second walls 132 and 130, respectively, and side walls 137 of the system 100. One or more sensors may be provided to detect status of the system such as folded, unfolded, loaded (e.g., with package), weight, temperature, presence information (e.g., a person present near, such as in front of the system 200, etc.). Presence information may be provided via a motion sensor(s) and/or a camera(s), for example. Such sensor information may be communicated wirelessly to a designated receiver, which may be the mobile phone of the owner of the system, for example. Contact sensors, such as electromagnetic and/or magnetic sensors, on two walls/panels may be provided, such as on at least one of the side walls and the front and/or back wall that contact each other when the system is folded, thus sensing and providing an indication of the system being folded when in contact, and not folded when not in contact with each other. In addition or alternately, such paired contact sensors may also be provided on the cover and the front wall, for example, where contact between two portions of the contact sensor contact, and/or are in close proximity to, each other when the front cover portion covers a portion of the front wall in the folded configuration. In response to detection of the system being unfolded and/or a package in the system by one of the sensors, an alert may be transmitted to a registered address (e.g., of a mobile station of a user, etc. such as to the mobile/smart phone of a registered owner of the system, etc.), for example, providing details, such as time of delivery, weight, temperature, and/or an image (still or video) of the person delivering the package, and/or an image of the interior contents of the package. Thereafter, once closed, the system may monitor for any motion and/or changes and may alert a user (e.g., the registered user) as described above of these changes. For example, in response to or upon detecting the presence of an individual (e.g., via image analysis, presence and/or proximity information), the system may capture an image of the individual (e.g., using an exterior camera(s) located at one or more portions of one or more panels of the container) and may forward this image and/or other information (e.g., time, audio information (e.g., captured by a microphone of the system), status information (e.g., locked, no motion, etc.) an address of a registered user.

Illustratively, an exterior camera(s) may be located at the second/front portion 108-2 of the cover 108 and/or the second/front wall 130, which may be at the lower portion of the second/front wall 130 below the strike 124 so that the camera is not covered by the cover's second/front portion 108-2 in the folded configuration, in which case only one camera may suffice and a second camera on the cover's second/front portion 108-2 would not be needed. Such a camera at the lower portion of the second/front wall 130 may point slightly upward to provide a better view of the person delivering a package, for example.

Accordingly, the system may include one or more sensors such as image sensors (e.g., interior and/or exterior), proximity sensors, presence sensors, temperature sensors, motion sensors (e.g., accelerometers, global positioning system (GPS) sensors, etc.), orientation sensors, gravity sensors, acceleration sensors, compass, etc. These sensors may form corresponding sensor information and may provide this information to a controller of the system using wired and/or wireless methods. The acceleration sensors may generate corresponding acceleration information and/or the compass may determine orientation of the system and form corresponding information that may be provided to the controller of the system. The controller may then analyze information provided thereto and determine the container is being manipulated, jimmied, or the like which may be indicative of an attempted break-in or access (generally break-in). Accordingly, if it is detected that a break-in or access event is occurring, the system may generate corresponding information and capture image information and forward this information to the registered user of the system via wired and/or wireless communication methods. Thereafter, the system may await a response of the registered user. For example, a user may then wirelessly interact with a UI of the system to transmit audio information to the controller of the system which may then render this information on a rendering device of the system such as a speaker (e.g., to output audio information, etc.). This information may alert potential thieves that their presence is known and/or may provide a delivery person with instructions to open the lock 202 (e.g., code is 1, 2, 3, 4, etc.).

The system 200 may include at least one solar panel 292 such as an EV panel to generate power from a light source such as sunlight. A controller of this system may then control charging of one or more power sources such as batteries, capacitors, etc. to receive the generated power and store it for later use. A controller of the system and a power source may be assumed for the sake of clarity to be situated under the solar panel 292.

Figure 11:
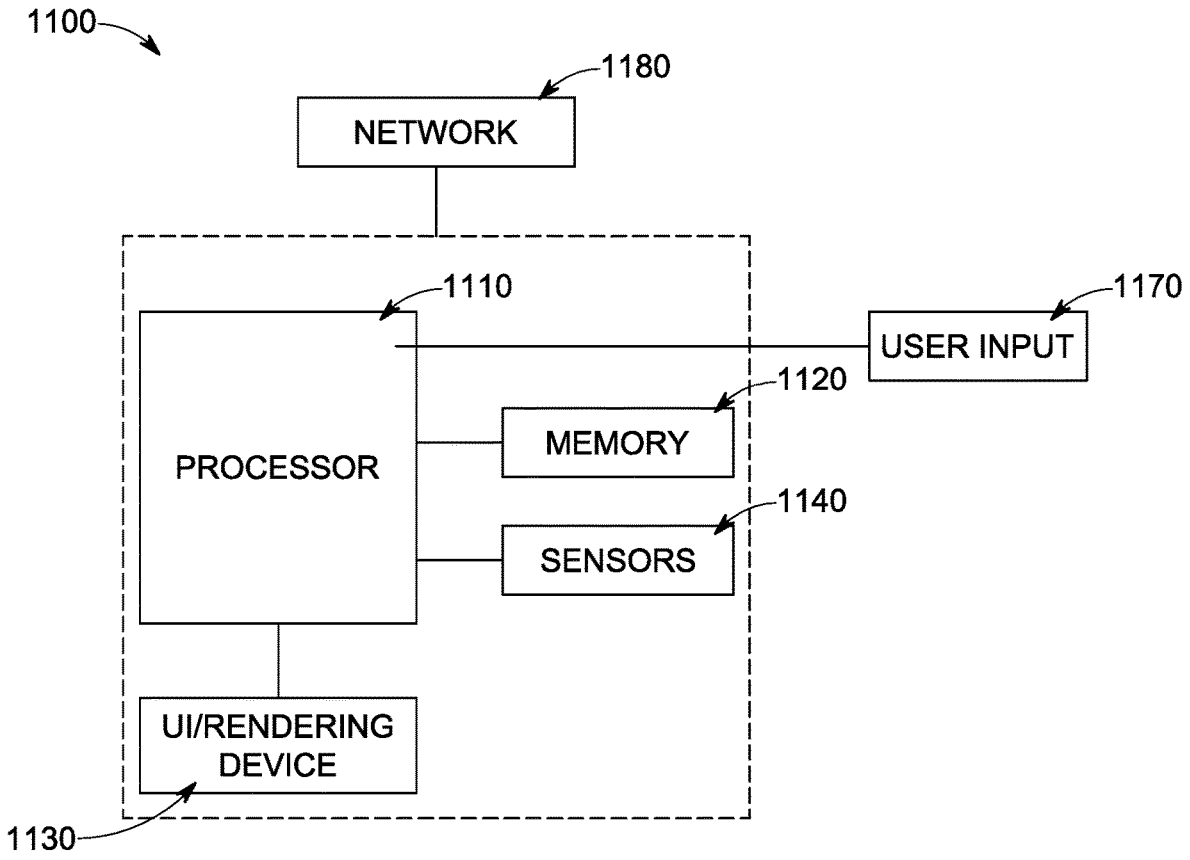
FIG. 11 shows a portion of a system in accordance with embodiments of the present system.

FIG. 11 shows a portion of a system 1100 in accordance with embodiments of the present system. For example, a portion of the present system may include a processor 1110 (e.g., a controller such as a microprocessor, etc.) operationally coupled to a memory 1120, a user interface (UI) including a rendering device such as a display 1130, sensors 1140, and a user input device 1170. The memory 1120 may be any type of device for storing application data as well as other data related to the described operation. The application data and other data are received by the processor 1110 for configuring (e.g., programming) the processor 1110 to perform operation acts in accordance with the present system. The processor 1110 so configured becomes a special purpose machine particularly suited for performing in accordance with embodiments of the present system.

The processor 1110 may render the content such as still or video information on a UI of the system. This information may include information related to operating parameters, instructions, feedback, and/or other information related to the operation of the system or portions thereof. The sensors 1140 may include sensors that may sense parameters of systems of the present system and may form sensor information, and provide this sensor information to the processor 1110.

The user input 1170 may include a keyboard, a mouse, a trackball, or other device, such as a touch-sensitive display, which may be stand alone or part of a system, such as part of a laptop, a personal digital assistant (PDA), a mobile phone (e.g., a smart phone, a mobile communication device), a smart watch, a smart phone, an e-reader, a monitor, a smart or dumb terminal or other device for communicating with the processor 1110 via any operable link such as a wired and/or wireless communication link. The user input device 1170 may be operable for interacting with the processor 1110 including enabling interaction within a UI as described herein. Clearly the processor 1110, the memory 1120, display 1130, and/or user input device 1170 may all or partly be a portion of a computer system or other device such as a client and/or server device.

The methods of the present system are particularly suited to be carried out by a computer software program, such program containing modules corresponding to one or more of the individual steps or acts described and/or envisioned by the present system. Such program may of course be embodied in a computer-readable medium, such as an integrated chip, a peripheral device or memory, such as the memory 1120 or other memory coupled to the processor 1110.

The program and/or program portions contained in the memory 1120 may configure the processor 1110 to implement the methods, operational acts, and functions disclosed herein. The memories may be distributed, for example between the clients and/or servers, or local, and the processor 1110, where additional processors may be provided, may also be distributed or may be singular. The memories may be implemented as electrical, magnetic or optical memory, or any combination of these or other types of storage devices. Moreover, the term "memory" should be construed broadly enough to encompass any information able to be read from or written to an address in an addressable space accessible by the processor 1110. With this definition, information accessible through a network 1180 is still within the memory, for instance, because the processor 1110 may retrieve the information from the network for operation in accordance with the present system.

The processor 1110 is operable for providing control signals and/or performing operations in response to input signals from the user input device 1170 as well as in response to other devices of a network and executing instructions stored in the memory 1120. The processor 1110 may include one or more of a microprocessor, an application-specific and/or general-use integrated circuit(s), a logic device, etc. Further, the processor 1110 may be a dedicated processor for performing in accordance with the present system and/or may be a general-purpose processor wherein only one of many functions operates for performing in accordance with the present system. The processor 1110 may operate utilizing a program portion, multiple program segments, and/or may be a hardware device utilizing a dedicated or multi-purpose integrated circuit.

The processor 1110 may be operable to control one or more containers and/or container systems. Similarly, the processor 1110 may be operable to control a power system, a charging system, communicating alerts or indications related to status of the container, and/or information related to the delivery person, as recorded via a camera and/or input by the delivery person via the user interface 1170 and/or 290, for example, and/or delivered packages included therein, and/or a locking system of a container device operating in accordance with embodiments of the present system.

Accordingly, embodiments of the present system may provide a system which monitors the state of charge of batteries and allows the system and/or user to control a charging rate of batteries and/or mode of operation of the system. A Bluetooth™ or Wi-Fi™ link between the rendering device 1130 (e.g., a user station (US) such as a mobile station (MS) like a smart phone, etc.) and the system may enable rendering of system parameters on a UI of the rendering device 1130 which may also provide an entry area in which a user may change parameters such as charging rate, etc. of the system. Additionally, this link may be configured to link two or more containers and/or mobile stations with a two-way connection. With this connection, energy storage system parameters such as battery parameters may be rendered and its charging rates and times may be adjusted. Excess power may be provided to mains power.

Further variations of the present system would readily occur to a person of ordinary skill in the art and are encompassed by the following claims.

Finally, the above-discussion is intended to be merely illustrative of the present system and should not be construed as limiting the appended claims to any particular embodiment or group of embodiments. Thus, while the present system has been described with reference to exemplary embodiments, it should also be appreciated that numerous modifications and alternative embodiments may be devised by those having ordinary skill in the art without departing from the broader and intended spirit and scope of the present system as set forth in the claims that follow. In addition, any section headings included herein are intended to facilitate a review but are not intended to limit the scope of the present system. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;
b) the word "a" or "an" preceding an element does not exclude the presence of a plurality of such elements;
c) any reference signs in the claims do not limit their scope;
d) several "means" may be represented by the same item or hardware or software implemented structure or function;
e) any of the disclosed elements may be comprised of hardware portions (e.g., including discrete and integrated electronic circuitry), software portions (e.g., computer programming), and any combination thereof;
f) hardware portions may be comprised of one or both of analog and digital portions;
g) any of the disclosed devices or portions thereof may be combined together or separated into further portions unless specifically stated otherwise;
h) no specific sequence of acts or steps is intended to be required unless specifically indicated;
i) the term "plurality of" an element includes two or more of the claimed element, and does not imply any particular range of number of elements; that is, a plurality of elements may be as few as two elements, and may include an immeasurable number of elements; and
j) the term and/or and formatives thereof should be understood to mean that only one or more of the listed elements may need to be suitably present in the system in accordance with the claims recitation and in accordance with one or more embodiments of the present system.

What is claimed is:

1. A storage container device, comprising:

a first wall configured to be coupled to a support and having bifurcated extensions extending therefrom;

a second wall opposed to the first wall and having bifurcated extensions extending therefrom;

side walls situated between, and coupled to, the corresponding bifurcated extensions of the first and second walls, the side walls each being configured to fold at a hinge situated between the first and second walls;

a bottom wall hingedly coupled to the first wall and configured to prevent the side walls from folding when in a down position, a cover having proximal and distal ends and a hinge situated therebetween, the cover being hingedly coupled to the first wall; and a frame and a sub-bottom wall coupled to the frame, wherein the sub-bottom wall is configured to support the bottom wall, wherein the bottom wall has one of a pull strap and an opening configured to allow pulling the bottom wall for rotation toward the first wall.

2. The storage container device of claim 1, further comprising a controller, at least one sensor, and a locking mechanism configured to selectively secure the cover to the second wall, wherein the controller is configured to receive information from the at least one sensor indicative of an attempted access to the storage container device and, in response to the information, perform at least one of providing an alert that occurrence of the attempted access is known and providing an instruction to unlock the locking mechanism.

3. The storage container device of claim 2, further comprising at least one renderer configured to render at least one of the alert and the instruction, and wherein the least one renderer includes at least one of a display and a speaker.

4. The storage container device of claim 2, wherein the at least one sensor includes at least one of an image sensor, a contact sensor, a proximity sensor, a presence sensor, a temperature sensor, a motion sensor, an orientation sensor, a gravity sensor, an acceleration sensor, and a compass, and wherein the alert is provided to a registered owner of the storage container device and includes at least one of an image captured by the image sensor, status information including at least one of a folded or unfolded status of the storage container device, a temperature, a weight of a package in the storage container device and a time of delivery of the package.

5. The storage container device of claim 1, wherein the bifurcated extensions of the first wall extend by a first distance from the first wall, wherein the bifurcated extensions of the second wall extend by a second distance from the second wall, and wherein the first distance is different from the second distance.

6. The storage container device of claim 1, wherein the bottom wall folds towards the cover to rest between the bifurcated extensions of the first wall, and wherein the bottom wall is held against the first wall in a folded position by at least one of an interference fit and a magnetic coupler.

7. The storage container device of claim 1, wherein a first hinge of a first side wall and a second hinge of a second side wall are asymmetrically located such that the first side wall and the second side wall are folded one in front of another.

8. The storage container device of claim 1, further comprising a controller and a locking mechanism configured to selectively secure the cover to the second wall, wherein the second wall comprises at least one first strike for locking the cover in an unfolded position and at least one second strike for locking the cover in a folded position, wherein the locking mechanism includes an electromagnetic fastening mechanism activated by the controller for locking at least one latch against at least one of the at least one first strike and the at least one second strike.

9. The storage container device of claim 1, wherein the first wall has at least two slotted openings configured to receive fasteners, respectively, wherein the at least two slotted openings each has a circular opening and a rectangular portion, the circular opening having a diameter larger than a width of the rectangular portion, and wherein a first slotted opening of the at least two slotted openings is located near a side edge of the first wall and a second slotted opening of the at least two slotted openings is located near a center of the first wall away from the side edge, the side edge being near one of the side walls.

10. A storage container device, comprising:

a first wall configured to be coupled to a support and having bifurcated extensions extending therefrom;

a second wall opposed to the first wall and having bifurcated extensions extending therefrom;

side walls having opposed ends and hinges situated between the opposed ends, the side walls being coupled to the corresponding bifurcated extensions of the first and second walls at the opposed ends, a bottom wall hingedly coupled to the first wall and configured to prevent the side walls from folding when in a down position; and a frame and a sub-bottom wall coupled to the frame, wherein the sub-bottom wall is configured to support the bottom wall.

11. The storage container device of claim 10, further comprising:

a cover having proximal and distal ends and a hinge situated therebetween, the cover being hingedly coupled to the first wall;

a controller;

a sensor operationally coupled to the controller; and a lock operationally coupled to the controller and configured to selectively secure the cover to the second wall, wherein the controller is configured to:

receive information from the sensor, and in response to the information, perform at least one of providing an alert, providing an instruction to unlock the lock, and unlocking the lock.

12. The storage container device of claim 10, further comprising a controller, at least one rechargeable power source, and a solar panel configured to generate power from a light source, wherein the controller is configured to control charging of the at least one rechargeable power source from the power generated by the solar panel.

13. The storage container device of claim 10, wherein a first hinge of a first side wall and a second hinge of a second side wall are asymmetrically located such that the first side wall and the second side wall are folded one in front of another.

14. The storage container device of claim 10, wherein the bottom wall has one of a pull strap and an opening configured to allow pulling the bottom wall for rotation toward the first wall.

15. A storage container device, comprising:

a first wall configured to be coupled to a support and having bifurcated extensions extending therefrom;

a second wall opposed to the first wall and having bifurcated extensions extending therefrom;

side walls having opposed ends and at least one hinge situated between the opposed ends, the side walls being coupled to the corresponding bifurcated extensions of the first and second walls at the opposed ends;

a bottom wall hingedly coupled to the first wall and configured to prevent the side walls from folding inward at the at least one hinge when in a down position, a cover having proximal and distal ends and a hinge situated between the proximal and distal ends, the cover being hingedly coupled to the first wall; and a frame and a sub-bottom wall coupled to the frame, wherein the sub-bottom wall is configured to support the bottom wall, wherein the bottom wall has one of a pull strap and an opening configured to allow pulling the bottom wall for rotation toward the first wall, and wherein the cover has a slot near the first wall for receiving a package while the storage container device is in a folded state.

16. The storage container device of claim 15, wherein the cover includes a moveable door that covers the slot, the moveable door being one of slidably and hingedly coupled to an outer surface of the cover, and wherein a first hinge of a first side wall and a second hinge of a second side wall are asymmetrically located such that the first side wall and the second side wall are folded one in front of another.

17. The storage container device of claim 15, further comprising a controller, a sensor, and a lock configured to selectively secure the cover to the second wall, wherein the controller is configured to:

receive information from the sensor, and in response to the information, perform at least one of providing an alert, providing an instruction to unlock the lock, and unlocking the lock.

* * * * *